US010002496B2

(12) United States Patent
Humphrey et al.

(10) Patent No.: US 10,002,496 B2
(45) Date of Patent: Jun. 19, 2018

(54) GAMING SYSTEM AND METHOD PROVIDING A KENO GAME INCLUDING AN OBJECT REMOVAL FEATURE THAT MAY TRIGGER A SECONDARY AWARD

(71) Applicant: IGT, Las Vegas, NV (US)

(72) Inventors: Thomas J. Humphrey, Reno, NV (US); Dylan B. Selegue, Reno, NV (US); Ross D. Wenker, Sparks, NV (US); Thomas W. Allen, II, Reno, NV (US)

(73) Assignee: IGT, Las Vegas, NV (US)

( * ) Notice: Subject to any disclaimer, the term of this patent is extended or adjusted under 35 U.S.C. 154(b) by 300 days.

(21) Appl. No.: 14/657,847

(22) Filed: Mar. 13, 2015

(65) Prior Publication Data

US 2016/0267741 A1 Sep. 15, 2016

(51) Int. Cl.
*G07F 17/32* (2006.01)

(52) U.S. Cl.
CPC ..... *G07F 17/329* (2013.01); *G07F 17/326* (2013.01)

(58) Field of Classification Search
None
See application file for complete search history.

(56) References Cited

U.S. PATENT DOCUMENTS 4,033,588 A 7/1977 Watts et al.
4,206,920 A 6/1980 Weatherford et al.
4,611,811 A 9/1986 Haase et al.
4,648,600 A 3/1987 Olliges
4,661,906 A 4/1987 DiFrancesco et al.
4,711,454 A 12/1987 Small
4,747,600 A 5/1988 Richardson et al.
4,775,155 A 10/1988 Lees
4,798,387 A 1/1989 Richardson
4,875,686 A 10/1989 Timms
5,005,840 A 4/1991 Schwartz et al.
5,043,887 A 8/1991 Richardson et al.
5,046,737 A 9/1991 Fienberg
5,072,381 A 12/1991 Richardson et al.
5,100,139 A 3/1992 Di Bella
5,116,049 A 5/1992 Sludikoff
5,158,293 A 10/1992 Mullins
5,351,970 A 10/1994 Fioretti et al.
5,380,007 A 1/1995 Travis et al.
(Continued)

*Primary Examiner* — Jay Liddle
(74) *Attorney, Agent, or Firm* — Neal, Gerber & Eisenberg LLP

(57) ABSTRACT

The present disclosure is directed to a gaming system and method providing a keno game including an object removal feature that may trigger a secondary award. In one embodiment, the keno game is associated with a plurality of keno numbers and a plurality of sets of objects. Each object is associated with one of the keno numbers. The gaming system displays the sets of objects in different layers stacked one atop the other. If an object removal event occurs during play of the keno game, the gaming system removes (at least) one of the displayed objects such that the object is no longer displayed, and determines if a secondary award triggering event occurred based on the removal of the object. If so, the gaming system determines and provides a secondary award. The occurrence of the object removal event thus provides an opportunity for the secondary award triggering event to occur.

22 Claims, 15 Drawing Sheets

(56) References Cited

U.S. PATENT DOCUMENTS 5,401,024 A 3/1995 Simunek
5,419,592 A 5/1995 Stuart et al.
5,482,289 A 1/1996 Weingardt et al.
5,569,083 A 10/1996 Fioretti et al.
5,586,937 A 12/1996 Menashe
5,639,089 A 6/1997 Matsumoto et al.
5,647,798 A 7/1997 Falciglia
5,651,735 A 7/1997 Baba
5,679,077 A 10/1997 Pocock et al.
5,687,971 A 11/1997 Khaladkar
5,718,631 A 2/1998 Invencion et al.
5,727,786 A 3/1998 Weingardt et al.
5,743,526 A 4/1998 Inoue
5,755,619 A 5/1998 Matsumoto et al.
5,779,545 A 7/1998 Berg et al.
5,823,534 A 10/1998 Bayai et al.
5,857,911 A 1/1999 Fioretti et al.
5,871,398 A 2/1999 Schneier et al.
5,909,875 A 6/1999 Weingardt et al.
5,935,001 A 8/1999 Baba et al.
5,935,002 A 8/1999 Falciglia
5,945,655 A 8/1999 Gilgeous et al.
6,017,032 A 1/2000 Grippo et al.
6,024,640 A 2/2000 Walker et al.
6,079,711 A 6/2000 Wei et al.
6,099,407 A 8/2000 Parker et al.
6,102,400 A 8/2000 Scott et al.
6,146,272 A 11/2000 Walker et al.
6,168,521 B1 1/2001 Luciano et al.
6,183,361 B1 2/2001 Cummings et al.
6,210,276 B1 4/2001 Mullins
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,315,290 B1 11/2001 Roethel
6,315,291 B1 11/2001 Moody
6,325,716 B1 12/2001 Walker et al.
6,358,151 B1 3/2002 Enzminger et al.
6,364,313 B1 4/2002 Moody
6,368,213 B1 4/2002 McNabola
6,368,214 B1 4/2002 Luciano
6,398,644 B1 6/2002 Perrie et al.
6,398,646 B1 6/2002 Wei et al.
6,402,614 B1 6/2002 Schneier et al.
6,425,823 B1 7/2002 Byrne
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,607,440 B2 8/2003 Santini, Jr.
6,609,973 B1 8/2003 Weiss
6,616,142 B2 9/2003 Adams
6,645,072 B1 11/2003 Kellen
6,656,044 B1 12/2003 Lewis
6,656,045 B2 12/2003 Wei et al.
6,722,655 B1 4/2004 Camero
6,755,738 B2 6/2004 Glasson et al.
6,755,739 B2 6/2004 Santini, Jr.
6,780,108 B1 8/2004 Luciano, Jr. et al.
6,802,776 B2 10/2004 Lind et al.
6,824,465 B2 11/2004 Luciano, Jr.
6,832,956 B1 12/2004 Boyd et al.
6,840,858 B2 1/2005 Adams
7,258,608 B2 8/2007 Khal
7,303,469 B2 12/2007 Kaminkow
7,306,519 B2 12/2007 Baerlocher
7,381,134 B2 6/2008 Cuddy et al.
7,399,227 B2 7/2008 Michaelson et al.
7,544,129 B2 6/2009 Baerlocher
7,563,164 B2 7/2009 D'Esposito
7,682,241 B2 3/2010 Baerlocher
7,824,257 B2 11/2010 Jubinville et al.
7,901,282 B2 3/2011 Cannon
7,941,709 B1 5/2011 Hong et al.
8,025,561 B2 9/2011 Reddicks et al.
8,333,648 B2 * 12/2012 Tarantino ..... G07F 17/32 463/18
8,430,737 B2 4/2013 Saunders
9,373,216 B2 * 6/2016 Trainor ..... G07F 17/3213
2001/0046891 A1 * 11/2001 Acres ..... A63F 3/0645 463/18
2002/0010015 A1 * 1/2002 Acres ..... A63F 3/0645 463/18
2002/0045472 A1 4/2002 Adams
2002/0052231 A1 5/2002 Fioretti
2002/0094859 A1 7/2002 Hirsch et al.
2002/0098883 A1 7/2002 Packes, Jr. et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0160830 A1 10/2002 Stern
2002/0169018 A1 11/2002 Schneier et al.
2002/0177478 A1 11/2002 Glasson et al.
2002/0193160 A1 12/2002 Tarantino
2003/0017867 A1 1/2003 Dekeller
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0054404 A1 3/2005 Baerlocher
2005/0054415 A1 3/2005 Kaminkow et al.
2005/0059449 A1 3/2005 Yarbrough
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064924 A1 3/2005 Glavich et al.
2005/0064932 A1 3/2005 Cannon
2005/0075161 A1 4/2005 McGlone et al.
2005/0096119 A1 5/2005 Lind et al.
2005/0096123 A1 5/2005 Cregan et al.
2005/0101370 A1 5/2005 Lind et al.
2005/0101387 A1 5/2005 Wolf
2005/0119042 A1 6/2005 Chamberlain et al.
2005/0130730 A1 6/2005 Lind et al.
2005/0148382 A1 7/2005 Fox
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0187014 A1 8/2005 Saffari et al.
2005/0227753 A1 10/2005 Luciano
2005/0255906 A1 11/2005 Lind et al.

(56) References Cited

U.S. PATENT DOCUMENTS

| | | | | |
|---|---|---|---|---|
| 2006/0084490 | A1 | 4/2006 | Khal | |
| 2006/0189375 | A1 | 8/2006 | Dodge | |
| 2006/0281522 | A1* | 12/2006 | Walker | G07F 17/32 463/18 |
| 2007/0021185 | A1 | 1/2007 | Walker et al. | |
| 2007/0117611 | A1 | 5/2007 | Dodge | |
| 2008/0102952 | A1 | 5/2008 | Walker et al. | |
| 2008/0108420 | A1 | 5/2008 | Groves | |
| 2008/0254894 | A1 | 10/2008 | Michaelson et al. | |
| 2009/0075715 | A1 | 3/2009 | Coleman et al. | |
| 2009/0197664 | A1 | 8/2009 | Schultz | |
| 2009/0275397 | A1* | 11/2009 | Van Baltz | G07F 17/32 463/25 |
| 2010/0120489 | A1 | 5/2010 | Meyer | |
| 2011/0028201 | A1 | 2/2011 | Warner et al. | |
| 2014/0194180 | A1* | 7/2014 | Elmqvist | G07F 17/329 463/18 |
| 2014/0335939 | A1* | 11/2014 | Leblanc | G07F 17/3213 463/20 |
| 2015/0194011 | A1* | 7/2015 | Carson | G07F 17/3202 463/18 |
| 2015/0254925 | A1* | 9/2015 | Wenker | G07F 17/329 463/18 |

* cited by examiner

FIG. 2B 1116,1118

| Primary Paytable | |
|---|---|
| Hits | Award |
| 4 | 1 |
| 5 | 5 |
| 6 | 25 |
| 7 | 100 |
| 8 | 250 |
| 9 | 750 |
| 10 | 1,500 |
| 11 | 3,000 |
| 12 | 5,000 |
| 13 | 10,000 |
| 14 | 15,000 |
| 15 | 25,000 |
| 16 | 50,000 |
| 17 | 75,000 |
| 18 | 100,000 |
| 19 | 200,000 |
| 20 | 250,000 |

285a

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

282

285b

| Secondary Paytable | |
|---|---|
| Number | All Objects Removed Award |
| Any of 1 to 10 | 2x Award Multiplier |
| Any of 11 to 20 | 5 Free Plays |
| Any of 21 to 30 | Wheel Spin Bonus Game |
| Any of 31 to 40 | 10x Bet Credit Award |
| Any of 41 to 50 | 10 Additional Ball Drops |
| Any of 51 to 60 | Progressive Award |
| Any of 61 to 70 | 5x Award Multiplier |
| Any of 71 to 80 | Remove 5 Random Objects |

| Player Number Set | Gaming System Number Set | # of Hits |
|---|---|---|
| 297 | 298 | 299 |

294 Start

295 Clear

296 Quick Pick

291 Award

292 Bet △ 5 ▽

293 Credit 1,000

1000

GAMING SYSTEM AND METHOD PROVIDING A KENO GAME INCLUDING AN OBJECT REMOVAL FEATURE THAT MAY TRIGGER A SECONDARY AWARD

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the U.S. Patent and Trademark Office patent file or records, but otherwise reserves all copyright rights whatsoever.

BACKGROUND

Keno in the United States traces back to a "Chinese lottery" game brought to the United States by Chinese immigrants in the 1800s. The "Chinese lottery" game utilized a board and a set of up to 120 characters instead of numbers. Early versions of American keno used characters on keno tickets rather than the numbers used today. The American keno game reduced the number of characters to the more familiar eighty.

When gambling was legalized in the state of Nevada in 1931, the "Chinese lottery" game was instead referred to as "Horse Race Keno," reflecting the idea that the numbers are horses and the players want their wagered-on horses to come in. Later, the name was shortened to simply keno, although the game is still often referred to as "Horse Race Keno."

Keno is similar to a lottery. The goal in keno, like in a lottery, is for a player to choose winning numbers from a plurality of numbers. In most standard versions of paper- or video-based keno, a player receives a card with eighty squares numbered 1 to 80 and arranged in eight rows of ten squares (i.e., an 8×10 matrix or grid). The player can wager on any number or numbers up to a designated quantity of numbers, such as ten numbers. The player chooses numbers on which the player desires to wager by marking those numbers on a keno card (such as in a paper version of keno) or by selecting the numbers using a touch-screen display (such as in a video version of keno). A clerk or the processor of the video display records the player's wager(s). The player pays for each number played or wagered on.

In one known paper version, the keno numbers also appear on eighty ping pong-type balls that can be tossed about in a clear plastic sphere or spun around in a wire bird cage. Keno numbers were at one time drawn from such apparatuses without replacement using a manually powered keno goose. In one known video version, a computer generates the keno numbers without replacement using a random number generator. After a number is chosen, that number is shown electronically on keno boards throughout the casino or on the video display. An award is provided to the player based on a quantity of matches between the player-selected number(s) and the game-generated number(s).

Many casinos offer "multi-race" cards that enable the player to play the same set of numbers over multiple games. One type of "multi-play" game enables the player to wager on a single set of numbers over as many as twenty games. When finished, the player must return to the keno station and cash in any wins. "Stray and play" tickets are also available, and enable the player to play a version of keno called "walk away keno." Here, players can purchase a keno ticket for an extended number of games, enjoy other activities in the casino, and return at a later time or even a later date to have the tickets checked by a computer for winning games.

Another option for keno players is a combination or "way" ticket. A combination ticket enables the player to group different numbers, wherein each group has the same amount numbers, creating more than one way to win. For example, a 3×3×3, nine spot ticket enables the player to select a combination of three groups of three numbers. The player can, for example, mark a first group of three numbers with the letter "A," mark a second group with the letter "B," and mark a third group the letter "C." This ticket enables the player to win on any winning combination of three numbers for any of the three groups. Hitting any winning combination pays as though a single ticket had been played. Essentially, the player plays three games on one card. In some keno games, playing three numbers in three games enables the player to play, or provides to the player, an additional nine spot game.

The "way" ticket supposedly makes keno more exciting, enabling players to wager more money on more numbers. In reality, playing a way or combination ticket offers no mathematical advantage, and causes no disadvantage, to the player. Some casinos offer discounted minimum wagers with "way" tickets. If the player plays three or more ways, many casinos will discount the price per "way" (e.g., let the player wager $0.50 per wager instead of a usual $1 minimum). However, the casino only pays back on the player's actual wager.

Certain variations of keno have expected returns that are relatively constant regardless of how many numbers the player plays. That is, it does not mathematically matter how many numbers the player chooses or if the player combines wagers. The player can choose fewer numbers if the player likes to win a smaller amount but a little more often. The player can choose more numbers if the player does not care about the frequency of the wins but wants bigger payouts. In other versions, the expected value fluctuates based on how many numbers the player plays.

Keno is a popular game that has been embodied in various types of gaming systems. A need exists to provide variations of keno and keno gaming systems and methods to make the play of keno more enjoyable, fun, and exciting for players.

SUMMARY

The present disclosure is directed to a gaming system and method providing a keno game including an object removal feature that may trigger a secondary award.

Generally, various embodiments of the gaming system of the present disclosure are configured to operate a keno game associated with a plurality of different keno numbers and a plurality of sets of objects. Each object is associated with one of the keno numbers. The gaming system displays the sets of objects in different layers stacked one atop the other. During a play of the keno game, the gaming system forms a player keno number set, randomly selects a designated quantity of the keno numbers to form a gaming system keno number set, determines any primary award by comparing the player and gaming system keno number sets, and provides any determined primary award. If an object removal event occurs during the play of the keno game, the gaming system removes (at least) one of the displayed objects such that the object is no longer displayed, and determines if a secondary award triggering event occurred based on the removal of the object. If so, the gaming system determines and provides a secondary award. The occurrence of the object removal event during the play of the keno game thus provides an opportunity for the secondary award triggering event to occur and for the gaming system to provide the secondary award.

In one embodiment, the object removal event occurs when: (i) the gaming system selects a keno number for inclusion in the gaming system keno number set, and (ii) at least one displayed object is associated with the selected keno number. Further, in this embodiment, the secondary award triggering event occurs when, following the removal of an object associated with a particular keno number, no more objects associated with that particular keno number are displayed. Here, when the gaming system selects a keno number for inclusion in the gaming system number set and when at least one displayed object is associated with the selected keno number (i.e., when the object removal event occurs in this embodiment), the gaming system removes one displayed object associated with the selected keno number such that that object is no longer displayed. Following the removal of the object associated with the selected keno number, if no more displayed objects are associated with the selected keno number (i.e., if the secondary award triggering event occurs in this embodiment), the gaming system determines and provides a secondary award. Thus, in this embodiment, the selection of the plurality of keno numbers to form the gaming system keno number set during each play of the keno game results in the gaming system removing the objects associated with the selected keno numbers, which provides a plurality of opportunities for the secondary award triggering event to occur and the gaming system to provide the secondary award.

It should thus be appreciated that the keno game including an object removal feature of the present disclosure provides an increased level of excitement and enjoyment for certain players.

Additional features and advantages are described herein, and will be apparent from, the following Detailed Description and the Figures.

BRIEF DESCRIPTION OF THE FIGURES

FIGS. 2A, 2B, 2C, 2D, 2E, 2F, and 2G are screen shots of an example embodiment of the gaming system of the present disclosure providing one example of the keno game of the present disclosure.

DETAILED DESCRIPTION

Gaming System and Method Providing a Keno Game Including an Object Removal Feature that May Trigger a Secondary Award Various embodiments of the present disclosure are directed to a gaming system and method providing a keno game including an object removal feature that may trigger a secondary award.

Figure 1:
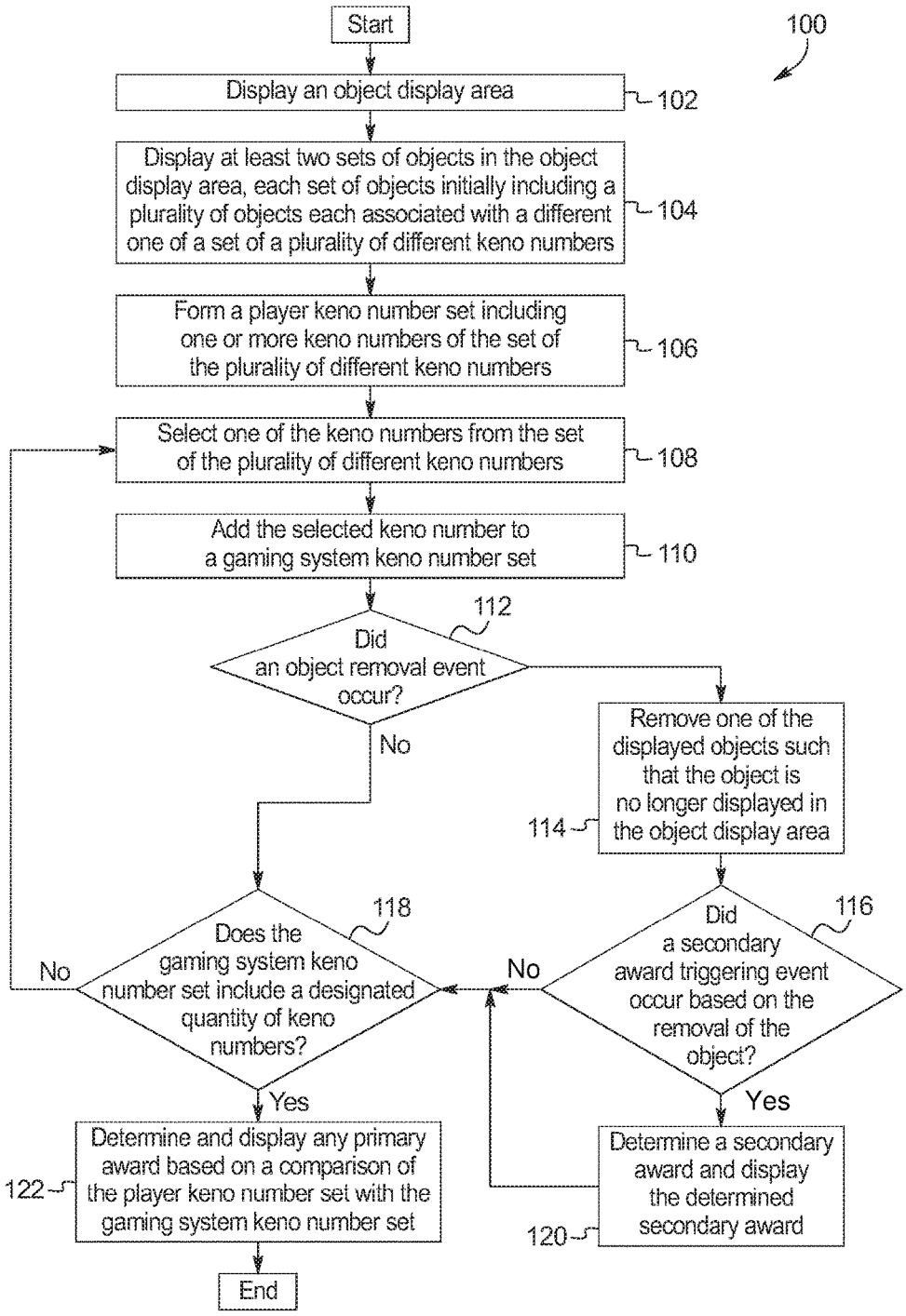
FIG. 1 is a flowchart of an example process or method of operating the gaming system to provide one example embodiment of the keno game of the present disclosure.

FIG. 1 is a flowchart of an example process or method 100 of operating the gaming system to provide one example embodiment of the keno game of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this embodiment, process 100 begins and the gaming system displays an object display area, as indicated by block 102. The gaming system displays at least two sets of objects in the object display area, as indicated by block 104. For each set of objects, that set of objects initially includes a plurality of objects and each of the objects of that set is associated with a different keno number of a set of a plurality of different keno numbers. For instance, in one example embodiment, the set of keno numbers includes keno numbers 1 to 80; each set of objects initially includes eighty objects; and, for each set of objects, the objects of that set are each associated with a different one of the keno numbers 1 to 80.

The gaming system forms a player keno number set including one or more keno numbers of the set of keno numbers (such as two to ten of the keno numbers), as indicated by block 106. More specifically, in this embodiment, the gaming system receives, from the player, a selection of the one or more keno numbers of the set of keno numbers to include in the player keno number set or an indication that the player desires the gaming system to select the one or more keno numbers of the set of keno numbers to include in the player keno number set.

The gaming system begins forming a gaming system keno number set by selecting one of the keno numbers in the set of keno numbers, as indicated by block 108. The gaming system adds the selected keno number to the gaming system keno number set, as indicated by block 110. The gaming system determines if an object removal event occurred, as indicated by diamond 112. If the gaming system determines at diamond 112 that the object removal event did not occur, the process 100 proceeds to diamond 118, described below. If, on the other hand, the gaming system determines at diamond 112 that the object removal event occurred, the gaming system removes one of the displayed objects such that the object is no longer displayed in the object display area, as indicated by block 114.

The gaming system determines if a secondary award triggering event occurred based (at least in part) on the removal of the object, as indicated by diamond 116. If the gaming system determines at diamond 116 that the secondary award triggering event occurred, the gaming system determines a secondary award and displays the determined secondary award, as indicated by block 120. Process 100 proceeds to diamond 118, described below.

If, on the other hand, the gaming system determines at diamond 116 that the secondary award triggering event did not occur (or if the gaming system determines at diamond 112 that the objet removal event did not occur), the gaming system determines if the gaming system keno number set includes a designated quantity of keno numbers, as indicated by diamond 118. If the gaming system determines at diamond 118 that the gaming system keno number set does not include the designated quantity of keno numbers, process 100 returns to block 108. If, on the other hand, the gaming system determines at diamond 118 that the gaming system keno number set includes the designated quantity of keno numbers, the gaming system determines any primary award based on a comparison of the player keno number set with the gaming system keno number set and displays any determined primary award, as indicated by block 122. Process 100 then ends.

The object removal event may be any suitable event. As noted above, upon an occurrence of the object removal event, the gaming system removes at least one displayed object such that the at least one removed object is no longer displayed in the object display area. In certain embodiments, the gaming system displays an indication of each removed object elsewhere, such as in a designated removed object display area distinct from the object display area.

In one embodiment, the object removal event occurs when: (i) the gaming system selects a keno number for inclusion in the gaming system keno number set, and (ii) at least one displayed object is associated with the selected keno number. For instance, in one example embodiment, the object removal event occurs when: (i) the gaming system selects the keno number 33 for inclusion in the gaming system keno number set, and (ii) at least one displayed object is associated with the keno number 33.

In another embodiment, the object removal event occurs when: (i) the gaming system selects a keno number for inclusion in the gaming system keno number set, (ii) the player keno number set includes the selected keno number, and (iii) at least one displayed object is associated with the selected keno number. For instance, in one example embodiment, the object removal event occurs when: (i) the gaming system selects the keno number 33 for inclusion in the gaming system keno number set, (ii) the player keno number set includes the keno number 33, and (iii) at least one displayed object is associated with the keno number 33.

In another embodiment, the object removal event occurs when the gaming system selects a keno number for inclusion in the gaming system keno number set regardless of whether any displayed objects are associated with the selected keno number. For instance, in one example embodiment, the object removal event occurs when the gaming system selects the keno number 33 for inclusion in the gaming system keno number set.

In one embodiment in which the gaming system can select a keno number for inclusion in the gaming system keno number set more than once (i.e., in which the gaming system selects keno numbers for inclusion in the gaming system keno number set with replacement), the object removal event occurs when: (i) the gaming system selects a keno number for inclusion in the keno number set a designated quantity of times, the designated quantity being at least two; and (ii) at least one displayed object is associated with the selected keno number. For instance, in one example embodiment, the object removal event occurs when: (i) the gaming system selects the keno number 33 for inclusion in the gaming system keno number set three times, and (ii) at least one displayed object is associated with the keno number 33.

In one embodiment, the object removal event is a mystery event that randomly occurs independent of any play of the keno game. Put differently, in this embodiment, for a play of the keno game, the gaming system randomly determines whether the object removal event will occur independent of and separate from the outcome of the play of the keno game.

In another embodiment, the object removal event occurs when a designated quantity of two or more "Hits" occur during play of the keno game. A "Hit" occurs when the gaming system selects a keno number to include in the gaming system keno number set that is also included in the player keno number set. For instance, in one example embodiment, the object removal event occurs when five "Hits" occur during play of the keno game.

In certain embodiments, the gaming system removes only one object when the object removal event occurs.

In one such embodiment in which the object removal event occurs in association with the gaming system selecting a keno number to include in the gaming system keno number set, the gaming system removes only one object that is associated with the selected keno number. For instance, in one example embodiment in which the object removal event occurs in association with the gaming system selecting a keno number to include in the gaming system keno number set and the gaming system selects the keno number 33 for inclusion in the gaming system keno number set, the gaming system removes only one object that is associated with the keno number 33.

In another such embodiment, the gaming system removes only one randomly-selected object when the object removal event occurs. For instance, in one example embodiment, when the object removal event occurs, the gaming system randomly selects only one displayed object and removes that object.

In another such embodiment, the gaming system removes only one player-selected object when the object removal event occurs. For instance, in one example embodiment, when the object removal event occurs, the gaming system receives a selection of one object from the player and removes that player-selected object.

In other embodiments, the gaming system removes two or more objects when the object removal event occurs.

In one such embodiment in which the object removal event occurs in association with the gaming system selecting a keno number to include in the gaming system keno number set, the gaming system removes two or more objects that are each associated with the selected keno number. For instance, in one example embodiment in which the object removal event occurs in association with the gaming system selecting a keno number to include in the gaming system keno number set and the gaming system selects the keno number 33 for inclusion in the gaming system keno number set, the gaming system removes two objects that are each associated with the keno number 33.

In another such embodiment, the gaming system removes a plurality of randomly-selected objects when the object removal event occurs. For instance, in one example embodiment, when the object removal event occurs, the gaming system randomly selects a plurality of displayed objects and removes that object.

In another such embodiment, the gaming system removes a plurality of player-selected objects when the object removal event occurs. For instance, in one example embodiment, when the object removal event occurs, the gaming system receives a selection of a plurality of objects from the player and removes those player-selected objects.

In another such embodiment, the gaming system removes a plurality of objects from the same set of objects when the object removal event occurs. For instance, in one example embodiment, when the object removal event occurs, the gaming system selects a plurality of displayed objects included in the same set of objects and removes those objects.

In another such embodiment, when the object removal event occurs, the gaming system removes at least one object from a first set of objects and at least one object from a second different set of objects.

In another such embodiment, when the object removal event occurs, the gaming system removes a plurality of objects form a first set of objects and a plurality of objects from a second different set of objects.

In another such embodiment, when the object removal event occurs, the gaming system removes a plurality of objects from a first set of objects and a plurality of objects from a second different set of objects.

In another such embodiment, when the object removal event occurs, the gaming system removes a plurality of objects according to a predetermined pattern. For instance, in one example embodiment, when the object removal event occurs, the gaming system removes a 2×2 group of displayed objects. In another example embodiment, when the object removal event occurs, the gaming system removes a 3×3 group of displayed objects. In another example embodiment, when the object removal event occurs, the gaming system removes an entire column of displayed objects. In another example embodiment, when the object removal event occurs, the gaming system removes an entire row of displayed objects.

In certain embodiments, when the object removal event occurs, the gaming system removes at least one displayed symbol from the object display area and does not remove any hidden objects from the object display area. In other embodiments, when the object removal event occurs, the gaming system removes at least one displayed object from the object display area and/or at least one hidden object from the object display area.

The secondary award may be any suitable award such as, but not limited to, one or more of: (1) monetary credits or currency; (2) non-monetary credits or currency; (3) a modifier (such as a multiplier) used to modify one or more awards (such as the primary award); (4) one or more free plays of a game (such as one or more free plays of the keno game); (5) one or more plays of one or more bonus games (such as a free spin of an award wheel); (6) one or more lottery based awards (such as one or more lottery or drawing tickets); (7) a wager match for one or more plays of the keno game; (8) an increase in an average expected payback percentage of a bonus game and/or an average expected payback percentage of the keno game for one or more plays; (9) one or more comps (such as a free dinner or a free night's stay at a hotel); (10) one or more bonus or promotional credits usable for online play; (11) one or more player tracking points; (12) a modifier (such as a multiplier) for player tracking points or credits; (13) an increase in a membership or player tracking level; (14) one or more coupons or promotions usable within a gaming establishment and/or outside of the gaming establishment (e.g., a 20% off coupon for use at a retail store or a promotional code providing a deposit match for use in association with an online casino); (15) an access code usable to unlock content on the Internet; (16) a progressive jackpot or other progressive award; (17) a high value product or service (such as a car); (18) a low value product or service (such as a teddy bear); (19) the removal of one or more objects; (20) an additional one or more ball drops; and (21) the accumulation of a removed object.

The secondary award triggering event may be any suitable event. As noted above, upon an occurrence of the secondary award triggering event, the gaming system determines and displays a secondary award.

In one embodiment, the secondary award triggering event occurs when, following the removal of an object associated with a particular keno number, no more objects associated with that particular keno number are displayed. For instance, in one example embodiment, the secondary award triggering event occurs when the gaming system removes the final object associated with the keno number 33 from the object display area such that no more objects associated with the keno number 33 are displayed in the object display area.

In another embodiment, the secondary award triggering event occurs when the gaming system removes an object such that the object is no longer displayed at the object display area. For instance, in one example embodiment, the secondary award triggering event occurs when the gaming system removes an object associated with the keno number 33 from the object display area.

In another embodiment, the secondary award triggering event occurs when the gaming system has removed a designated quantity of objects from the object display area. For instance, in one example embodiment, the secondary award triggering event occurs when the gaming system removes ten objects from the object display area.

In another embodiment, the secondary award triggering event occurs when the gaming system removes a designated quantity of objects from a particular set of objects. For instance, in one example embodiment, the secondary award triggering event occurs when the gaming system removes twenty objects from the first set of objects.

In another embodiment, the secondary award triggering event occurs when the gaming system removes all of the objects from a particular set of objects. For instance, in one example embodiment, the secondary award triggering event occurs when the gaming system removes all of the objects from the first set of objects.

In another embodiment, the secondary award triggering event occurs when the gaming system removes all of the objects from all of the sets of objects. For instance, in one example embodiment, the secondary award triggering event occurs when the gaming system removes all of the objects from all of the sets of objects and, accordingly, the gaming system provides a progressive award.

In another embodiment in which the gaming system displays the sets of objects layered one atop the other, the secondary award triggering event occurs when the gaming system has removed objects such that at least part of one layer at a designated depth is revealed. For instance, in one example embodiment in which the keno game is associated with three sets of objects displayed in a top, a middle, and a bottom layer, one atop the other, the secondary award triggering event occurs when the gaming system removes objects from two of the three layers such that at least part of the third layer is revealed.

In another embodiment in which the gaming system displays the sets of objects layered one atop the other, the secondary award triggering event occurs when the gaming system has removed objects such that the entirety of one layer at a designated depth is revealed. For instance, in one example embodiment in which the keno game is associated with three sets of objects displayed in a top, a middle, and a bottom layer, one atop the other, the secondary award triggering event occurs when the gaming system removes objects from two of the three layers such that the entire third layer is revealed.

In another embodiment, the secondary award triggering event occurs when the spaces in which removed objects used to be displayed form a designated pattern or one of a plurality of designated patterns. For instance, in one example embodiment, the secondary award triggering event occurs when the spaces in which removed objects used to be displayed form a cross pattern.

In certain embodiments, one, a plurality but less than all of, or all of the objects are associated with a secondary award or one of a plurality of different secondary awards. In these embodiments, the secondary award triggering event occurs when the gaming system removes an object that is associated with a secondary award. For instance, in one example embodiment, ten of the eighty displayed objects are associated with a secondary award of 1 Free Play. In this example embodiment, the secondary award triggering event occurs when the gaming system removes one of the ten objects associated with the secondary award and the secondary award triggering event does not occur when the gaming system removes one of the seventy objects not associated with the secondary award.

In various embodiments, the gaming system enables the player to collect or accumulate removed objects during the play of the keno game or over the course of a plurality of plays of the keno game. In one such embodiment, the secondary award triggering event occurs when the player has collected each object of a designated set of objects (such as a set of the objects associated with the keno numbers 1 to 10 or a set of the objects associated with a same characteristic (such as a same color or pattern).

It should be appreciated that the keno game may be associated with any suitable combination of the above-identified secondary award triggering events. For instance, in one example embodiment, the keno game is associated with a first secondary award triggering event that occurs when, following the removal of an object associated with a particular keno number, no more objects associated with that particular keno number are displayed, and a second secondary award triggering event that occurs when the gaming system has removed all displayed objects from the object display area.

It should also be appreciated that the occurrence of different secondary award triggering events may result in the determination of different secondary awards. For instance, in one example embodiment, the gaming system determines more valuable secondary awards upon the occurrences of relatively rarer secondary award triggering events (e.g., removal of all displayed objects from the object display area) than the gaming system does upon the occurrences of relatively common secondary award triggering events (e.g., removal of all displayed objects associated with the keno number 33).

FIGS. 2A, 2B, 2C, 2D, 2E, 2F, and 2G are screenshots of an example embodiment of the gaming system of the present disclosure configured to operate one example of the keno game of the present disclosure.

In this example embodiment, the keno game is associated with: (1) a set of keno numbers including the numbers 1 through 80 (though it should be appreciated that the keno game may be associated with any suitable numbers or range of numbers and/or any suitable symbols (such as letters, characters, themed images, and the like) instead of or in addition to numbers); (2) a first set of eighty first objects, each of which is associated with a different one of the set of keno numbers 1 through 80; (3) a second set of eighty second objects, each of which is associated with a different one of the set of keno numbers 1 through 80; and (4) a set of eight different available secondary awards, each of which is associated with a different plurality of the set of keno numbers 1 through 80. While the objects are shown as cubes in this embodiment, the objects may take any suitable shape or shapes. Additionally, the keno game may be associated with any suitable quantity of sets of objects.

In this example embodiment: (1) a secondary award of a 2× Award Multiplier is associated with the keno numbers 1 through 10, (2) a secondary award of 5 Free Plays is associated with the keno numbers 11 to 20, (3) a secondary award of a Wheel Spin Bonus Game is associated with the keno numbers 21 to 30, (4) a secondary award of a 10× Bet Credit Award is associated with the keno numbers 31 to 40, (5) a secondary award of 10 Additional Ball Drops is associated with the keno numbers 41 to 50, (6) a secondary award of a Progressive Award is associated with the keno numbers 51 to 60, (7) a secondary award of a 5× Award Multiplier is associated with the keno numbers 61 to 70, and (8) a secondary award of a Removal of 5 Random Objects is associated with the keno numbers 71 to 80.

Figure 2A:
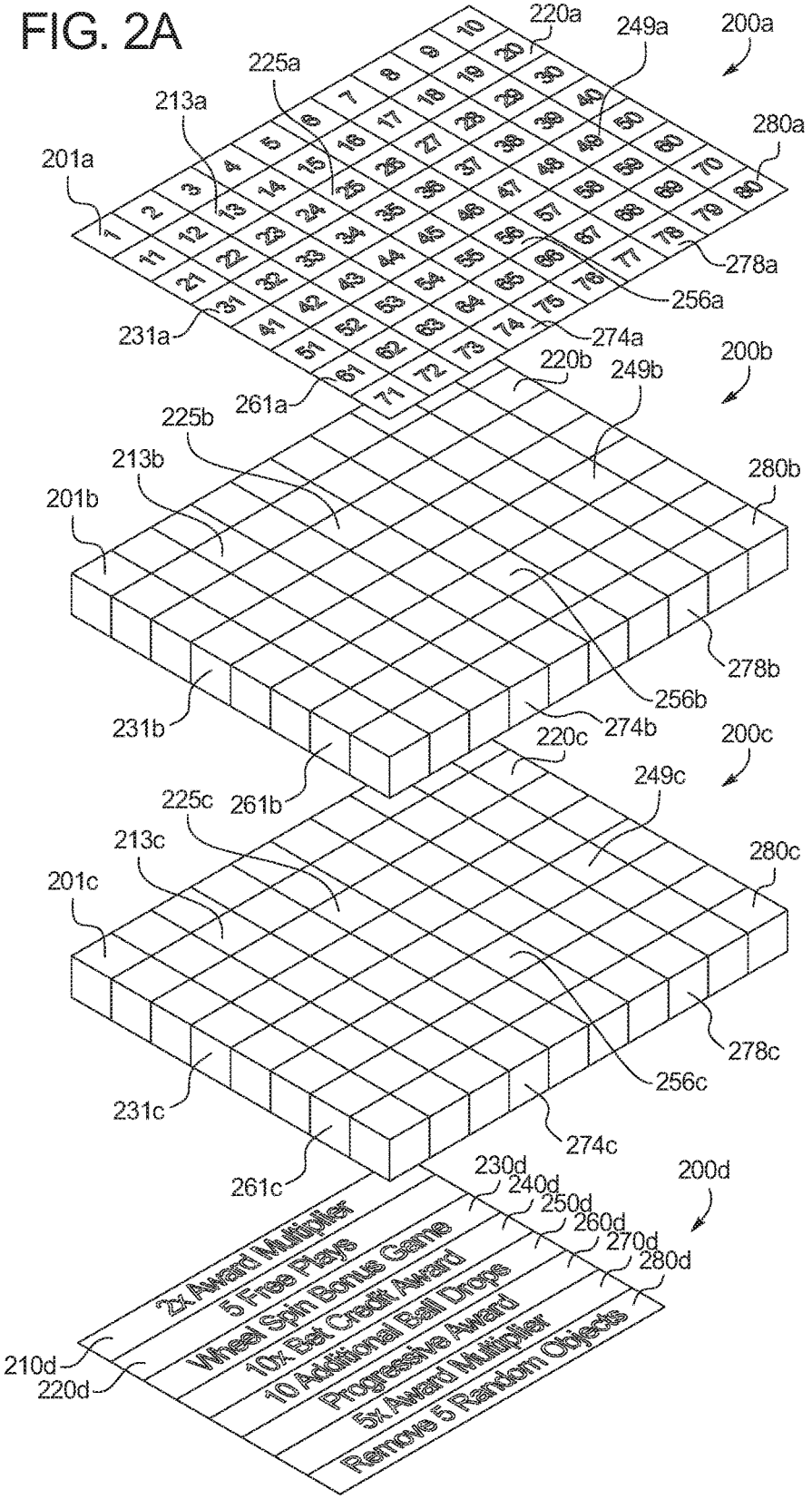

As shown in an exploded fashion for clarity in FIG. 2A, the keno game is associated with and the gaming system displays (such as on a display device 1116 or 1118, described below): a first layer 200*a*; a second layer 200*b* positioned beneath and aligned with the first layer 200*a*; a third layer 200*c* positioned beneath and aligned with the first layer 200*a* and the second layer 200*b*; and a fourth layer 200*d* positioned beneath and aligned with the first layer 200*a*, the second layer 200*b*, and the third layer 200*c*.

The first layer 200*a* includes an 8×10 matrix including eighty keno number positions 201*a* to 280*a*. The gaming system displays a different one of the keno numbers of the set of keno numbers 1 through 80 at each of the keno number position 201*a* to 280*a*.

The second layer 200*b* includes the first plurality of first objects 201*b* through 280*b* arranged adjacent to one another in an 8×10 matrix. The first objects 201*b* through 280*b* are arranged such that each first object is aligned with and positioned beneath the keno number position at which the keno number associated with that first object is displayed. For example, the gaming system displays the first object 201*b* associated with the keno number 1 such that the first object 201*b* is positioned beneath the keno number position 201*a* at which the gaming system displays the keno number 1.

The third layer 200*c* includes the second plurality of second objects 201*c* through 280*c* arranged adjacent to one another in an 8×10 matrix. The second objects 201*c* through 280*c* are arranged such that each second object is aligned with and positioned beneath: (i) the keno number position at which the keno number associated with that second object is displayed, and (ii) the first object associated with the same keno number as that second object. For example, the gaming system displays the second object 201*c* associated with the keno number 1 such that the second object 201*c* is positioned beneath: (i) the keno number position 201*a* at which the gaming system displays the keno number 1, and (ii) the first object 201*b* that is also associated with the keno number 1.

The fourth layer 200*d* includes an 8×1 matrix including eight secondary award positions 210*d* to 280*d*. The gaming system displays a different one of the eight available secondary awards at each of the secondary award positions

210*d* to 280*d*. Specifically, the gaming system displays: (1) the secondary award position 210*d* displaying the 2× Award Multiplier secondary award beneath and aligned with the keno number positions 201*a* to 210*a*, the first objects 201*b* to 210*b*, and the second objects 201*c* to 210*c*; (2) the secondary award position 220*d* displaying the 5 Free Plays secondary award beneath and aligned with the keno number positions 211*a* to 220*a*, the first objects 211*b* to 220*b*, and the second objects 211*c* to 220*c*; (3) the secondary award position 230*d* displaying the Wheel Spin Bonus Game secondary award beneath and aligned with the keno number positions 221*a* to 230*a*, the first objects 221*b* to 230*b*, and the second objects 221*c* to 230*c*; (4) the secondary award position 240*d* displaying the 10× Bet Credit Award secondary award beneath and aligned with the keno number positions 231*a* to 240*a*, the first objects 231*b* to 240*b*, and the second objects 231*c* to 240*c*; (5) the secondary award position 250*d* displaying the 10 Additional Ball Drops secondary award beneath and aligned with the keno number positions 241*a* to 250*a*, the first objects 241*b* to 250*b*, and the second objects 241*c* to 250*c*; (6) the secondary award position 260*d* displaying the Progressive Award secondary award beneath and aligned with the keno number positions 251*a* to 260*a*, the first objects 251*b* to 260*b*, and the second objects 251*c* to 260*c*; (7) the secondary award position 270*d* displaying the 5× Award Multiplier secondary award beneath and aligned with keno number positions 261*a* to 270*a*, the first objects 261*b* to 270*b*, and the second objects 261*c* to 270*c*; and (8) the secondary award position 280 displaying the Remove 5 Random Objects secondary award beneath and aligned with the keno number position 271*a* to 280*a*, the first objects 271*b* to 280*b*, and the second objects 271*c* to 280*c*.

In this example embodiment, the object removal event occurs when: (i) the gaming system selects a keno number for inclusion in the gaming system keno number set, and (ii) at least one displayed object is associated with the selected keno number. Thus, in this example embodiment, the gaming system determines whether the object removal event occurs following each selection of a keno number for inclusion in the gaming system keno number set. Additionally, in this example embodiment, when the gaming system selects a keno number for inclusion in the gaming system number set and when at least one displayed object is associated with the selected keno number (i.e., when the object removal event occurs), the gaming system removes the topmost displayed object associated with the selected keno number.

Further, in this example embodiment, the secondary award triggering event occurs when, following the removal of an object associated with a particular keno number, no more objects associated with that particular keno number are displayed. Thus, in this example embodiment, the gaming system determines whether the secondary award triggering event occurs following each removal of an object from the object display area. In this example embodiment, when the gaming system removes the final displayed object associated with a particular keno number (i.e., when the secondary award triggering event occurs), the gaming system provides the secondary award associated with that particular keno number. For instance, when the gaming system removes the second object 203*c* associated with the keno number 3 (i.e., when the secondary triggering event occurs), the gaming system provides the 2× Award Multiplier (i.e., the secondary award associated with the keno number 3).

As shown in FIG. 2B, the gaming system displays the first, second, third, and fourth layers 200*a*, 200*b*, 200*c*, and 200*d* in an object display area 282 in a top plan view such that the first layer 200*a* of the keno number positions 201*a* to 280*a* is visible (because the first layer 200*a* is the top layer) and the that second layer 200*b* of the first objects 201*b* to 280*b* is substantially visible through the first layer 200*a* (because the first layer 200*a* is substantially transparent aside from the keno numbers). The third layer 200*c* of the second objects 201*c* to 280*c* is initially not visible because the second layer 200*b* initially blocks the third layer 200*c*. The fourth layer 200*d* of the secondary award positions 210*d* to 280*d* is initially not visible because the second layer 200*b* and the third layer 200*c* initially block the fourth layer 200*d*.

In this example embodiment, the gaming system displays a primary paytable 285*a* and a secondary paytable 285*b*. The primary paytable 285*a* indicates a plurality of quantities of "Hits" and a corresponding award amount for each "Hit". A "Hit" occurs when the gaming system selects a keno number to include in the gaming system keno number set that is also included in the player keno number set, as described below. In this example embodiment, the quantity of "Hits" included in the paytable 285*a* and the corresponding award amounts are determined based on a player keno number set including ten keno numbers and a bet of 5 credits. It should be appreciated that both the quantity of "Hits" and the corresponding award amounts included in the paytable 285*a* may vary when the player keno number set includes fewer than or more than ten keno numbers and/or when the bet is greater than or less than 5 credits. The secondary paytable 285*b* indicates each of the eight available secondary awards (listed above) and the keno numbers associated with the available secondary awards. It should be appreciated that the secondary awards may vary and that any suitable keno number(s) may be associated with any of the secondary awards.

The gaming system also displays: (a) a plurality of meters including: (i) an award meter 291 that displays any awards won for a play of the keno game (in credit or currency form); (ii) a bet meter 292 that displays any bet placed on a play of the keno game (in credit or currency form), (iii) a credit meter 293 that displays the credit balance of the player (in credit or currency form), (vi) a player keno number set meter 297 that displays the player keno number set for a play of the keno game, (v) a gaming system keno number set meter 298 that displays the gaming system keno number set for a play of the keno game, and (vi) a hit meter 299 that displays the quantity of hits for a play of the keno game; and (b) a plurality of virtual buttons actuatable by the player including: (i) a Start button 294 that, when actuated by the player, causes the gaming system to initiate a play of the keno game; (ii) a Clear button 295 that, when actuated by the player, causes the gaming system to remove any keno numbers from the player keno number set; (iii) a Quick Pick button 296 that, when actuated by the player, causes the gaming system to randomly determine which keno numbers to include in the player keno number set; and (iv) increase and decrease bet buttons (not labeled) included in the bet meter 292 that, when actuated by the player, respectively increase and decrease the quantity of credits or currency displayed by the bet meter 292.

Turning to FIG. 2B, in operation of this example embodiment, the gaming system receives a deposit of value from the player and provides the player with 1,000 credits, as shown in the credit meter 293. The gaming system displays a desired bet of 5 credits in the bet meter 292 and enables the player to modify the desired bet using the increase and/or decrease bet buttons. The gaming system enables the player to select which of the keno numbers to include in the player keno number set. More specifically, in this example embodiment, the gaming system enables the player to: (1) manually select between two and ten of the keno numbers to include in the player keno number set (such as via virtual buttons of a touch screen, physical soft keys, or dedicated physical hard keys, described below); or (2) actuate the Quick Pick button 296 to cause the gaming system to randomly select ten of the keno numbers to include in the player keno number set. Here, the gaming system receives an actuation of the Quick Pick button 296.

Figure 2C:
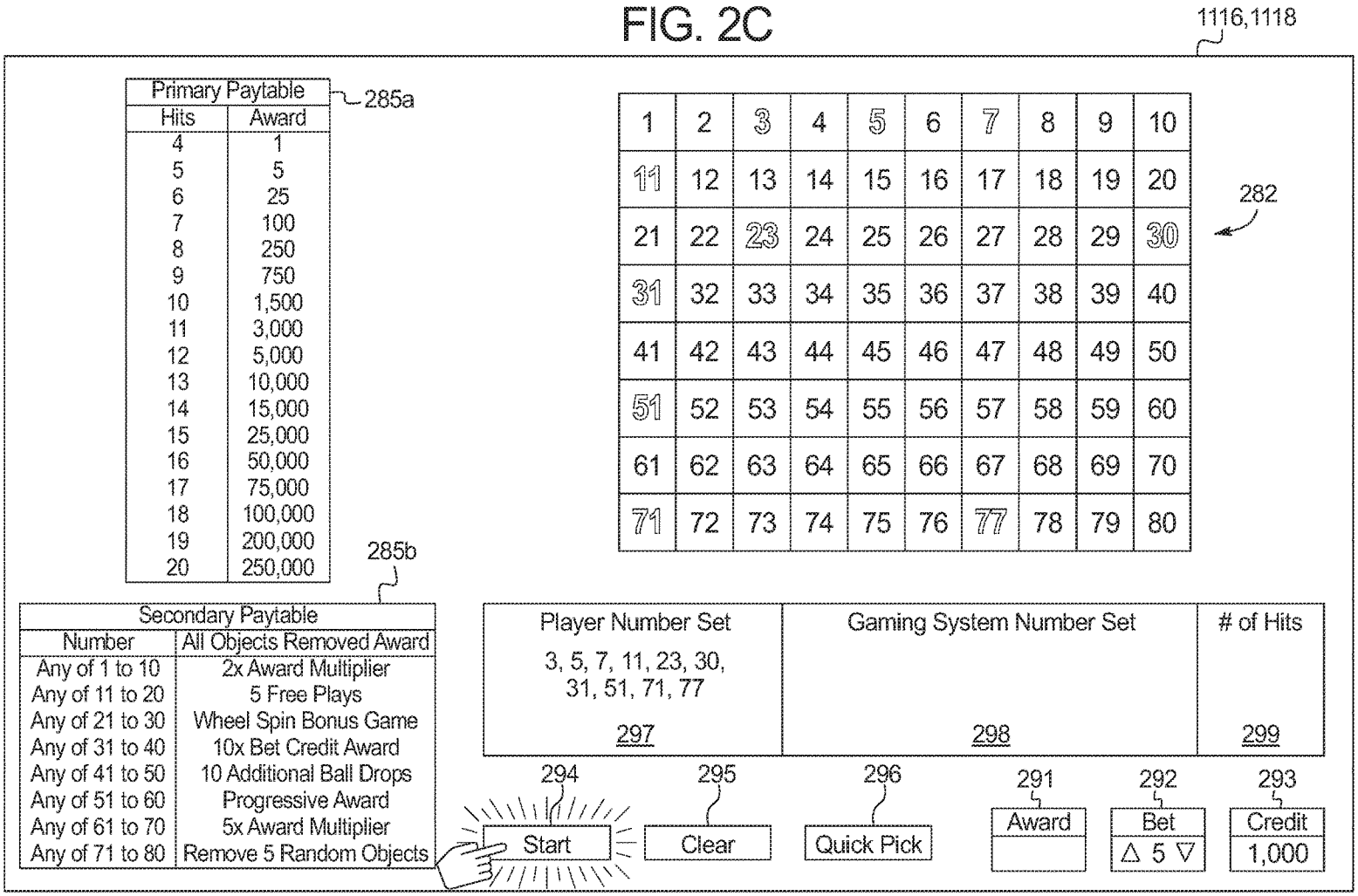

As shown in FIG. 2C, upon receiving the actuation of the Quick Pick button 296, the gaming system randomly selects the keno numbers 3, 5, 7, 11, 23, 30, 31, 51, 71, and 77 to include in the player keno number set and displays the selected keno numbers of the player keno number set in the player keno number set meter 297. In this example embodiment, the gaming system indicates that a keno number is included in the player keno number set by replacing the originally-displayed indication of the keno number in the first layer 200*a* with a larger, "bubble" number. It should be appreciated that the gaming system may indicate the keno numbers of the player keno number set in any suitable manner, such as by shading each of the corresponding keno number positions, coloring each of the corresponding keno number positions, displaying an icon in each of the corresponding keno number positions, changing the typeface used for the displayed indications of the keno numbers, displaying a pattern in each of the corresponding keno number positions, and the like. After the gaming system forms the player keno number set, the gaming system receives an actuation of the Start button 294 from the player.

After receiving the actuation of the Start button 294, the gaming system reduces the credit balance of the player by the desired 5 credit bet (from 1,000 credits to 995 credits, as shown in the credit meter 293) and begins randomly selecting the keno numbers to include in the gaming system number set. In this example embodiment, the gaming system selects the keno numbers to include in the gaming system keno number set from the set of keno numbers with replacement. In other words, in this example embodiment, the gaming system can select the same keno number for inclusion more than once in the gaming system keno number set.

Figure 2D:
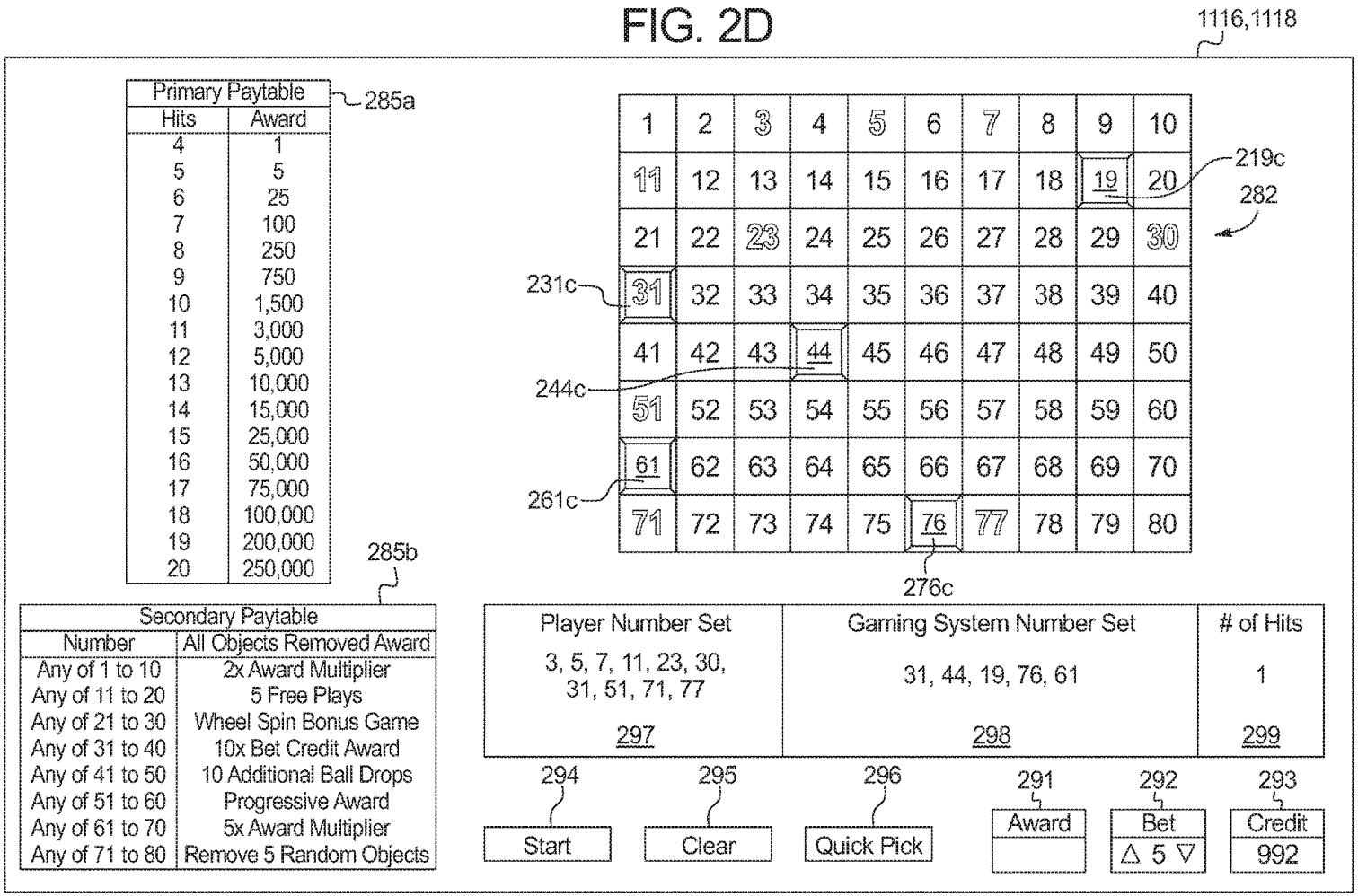

FIG. 2D illustrates a screenshot at a point in time at which the gaming system has: (1) randomly selected the keno number 31, added the keno number 31 to the gaming system keno number set, determined that the object removal event occurred because the first and second objects 231*b* and 231*c* associated with the keno number 31 were displayed in the object display area, removed the topmost displayed first object 231*b* from the object display area (thereby revealing the second object 231*c*), and determined that the secondary award triggering event did not occur in association with the removal of the first object 231*b*; (2) randomly selected the keno number 44, added the keno number 44 to the gaming system keno number set, determined that the object removal event occurred because the first and second objects 244*b* and 244*c* associated with the keno number 44 were displayed in the object display area, removed the topmost displayed first object 244*b* from the object display area (thereby revealing the second object 244*c*), and determined that the secondary award triggering event did not occur in association with the removal of the first object 244*b*; (3) randomly selected the keno number 19, added the keno number 19 to the gaming system keno number set, determined that the object removal event occurred because the first and second objects 219*b* and 219*c* associated with the keno number 19 were displayed in the object display area, removed the topmost displayed first object 219*b* from the object display area (thereby revealing the second object 219*c*), and determined that the secondary award triggering event did not occur in association with the removal of the first object 219*b*; (4) randomly selected the keno number 76, added the keno number 76 to the gaming system keno number set, determined that the object removal event occurred because the first and second objects 276*b* and 276*c* associated with the keno number 76 were displayed in the object display area, removed the topmost displayed first object 276*b* from the object display area (thereby revealing the second object 276*c*), and determined that the secondary award triggering event did not occur in association with the removal of the first object 276*b*; and (5) randomly selected the keno number 61, added the keno number 61 to the gaming system keno number set, determined that the object removal event occurred because the first and second objects 261*b* and 261*c* associated with the keno number 61 were displayed in the object display area, removed the topmost displayed first object 261*b* from the object display area (thereby revealing the second object 261*c*), and determined that the secondary award triggering event did not occur in association with the removal of the first object 261*b*.

The gaming system displays the selected keno numbers of the gaming system keno number set in the gaming system keno number set meter 298.

In this example embodiment, when the gaming system adds a keno number to the gaming system keno number set, the gaming system underlines the displayed indication of that keno number in the layer 200*a* to indicate that the gaming system added that keno number to the gaming system keno number set, though it should be appreciated that the gaming system may do so in any suitable manner (such as any of those described above).

The gaming system increments the hit meter 299 to one because the keno number 31 in the gaming system keno number set matches the keno number 31 in the player keno number set.

Figure 2E:
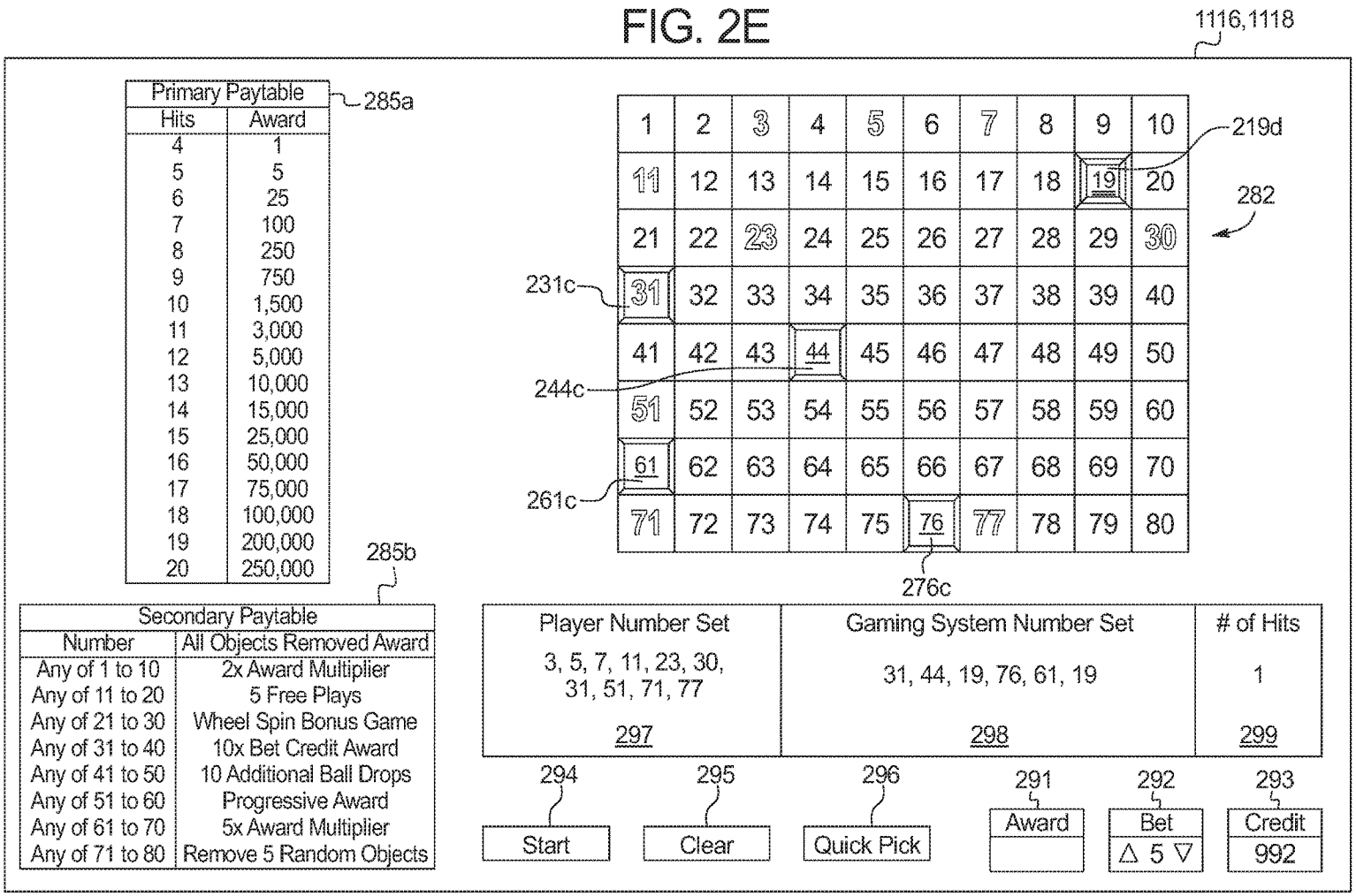
Figure 2F:
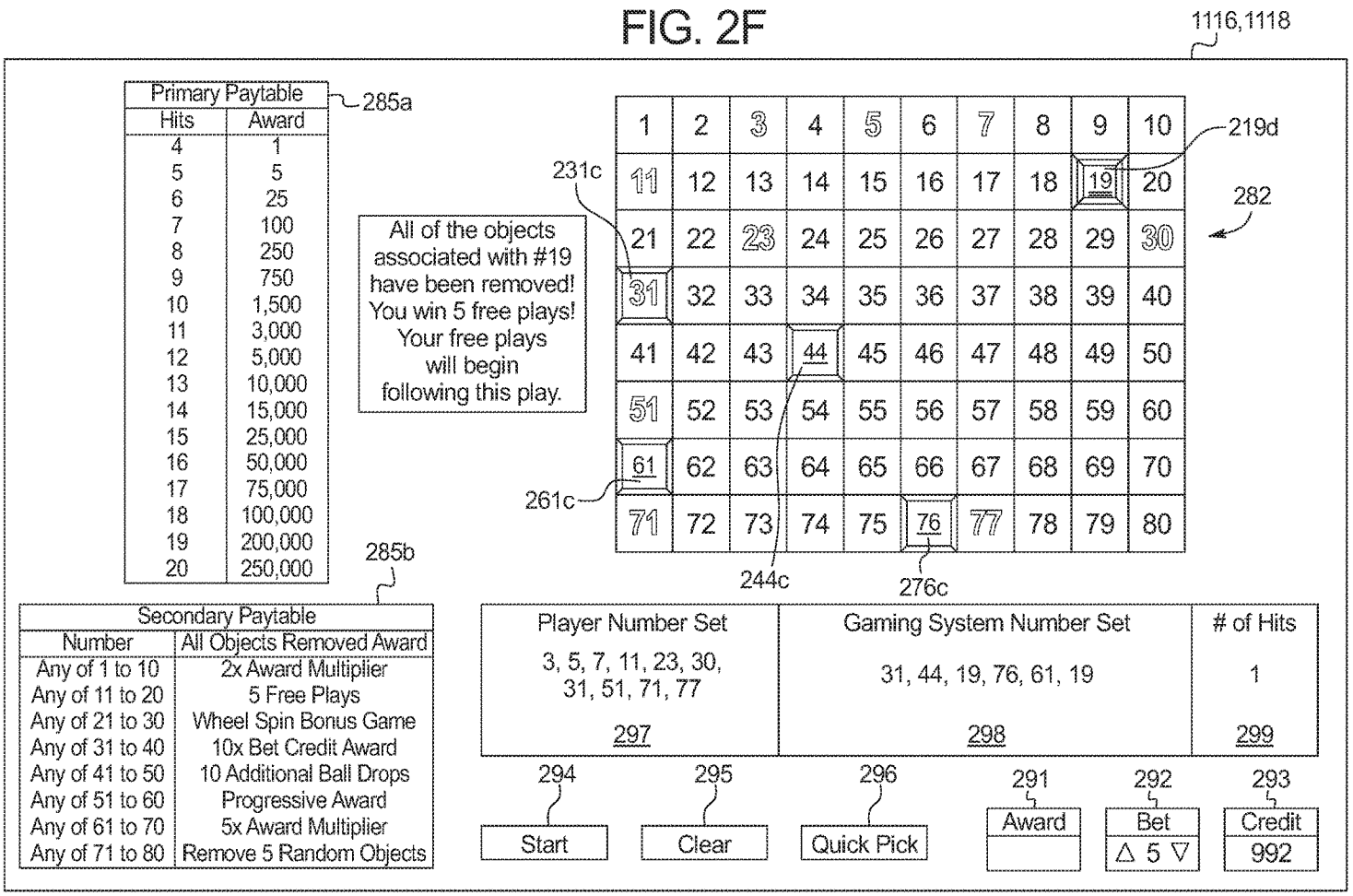

As shown in FIG. 2E, the gaming system randomly selects the keno number 19, adds the keno number 19 to the gaming system keno number set, and determines that the object removal event occurred because the second object 219*c* associated with the keno number 19 is displayed in the object display area. Accordingly, the gaming system removes the topmost displayed second object 219*c* from the object display area, thereby revealing a portion of the secondary award display area 220*d* of the fourth layer 200*d*. Since the removal of the second object 219*c* results in no more objects associated with the keno number 19 being displayed in the object display area, the gaming system determines that the secondary award triggering event occurs. Accordingly, as shown in FIG. 2F, the gaming system displays an indication of and provides the 5 Free Plays secondary award associated with the keno number 19. The gaming system displays the selected keno number 19 in the gaming system keno number set meter 298.

Figure 2G:
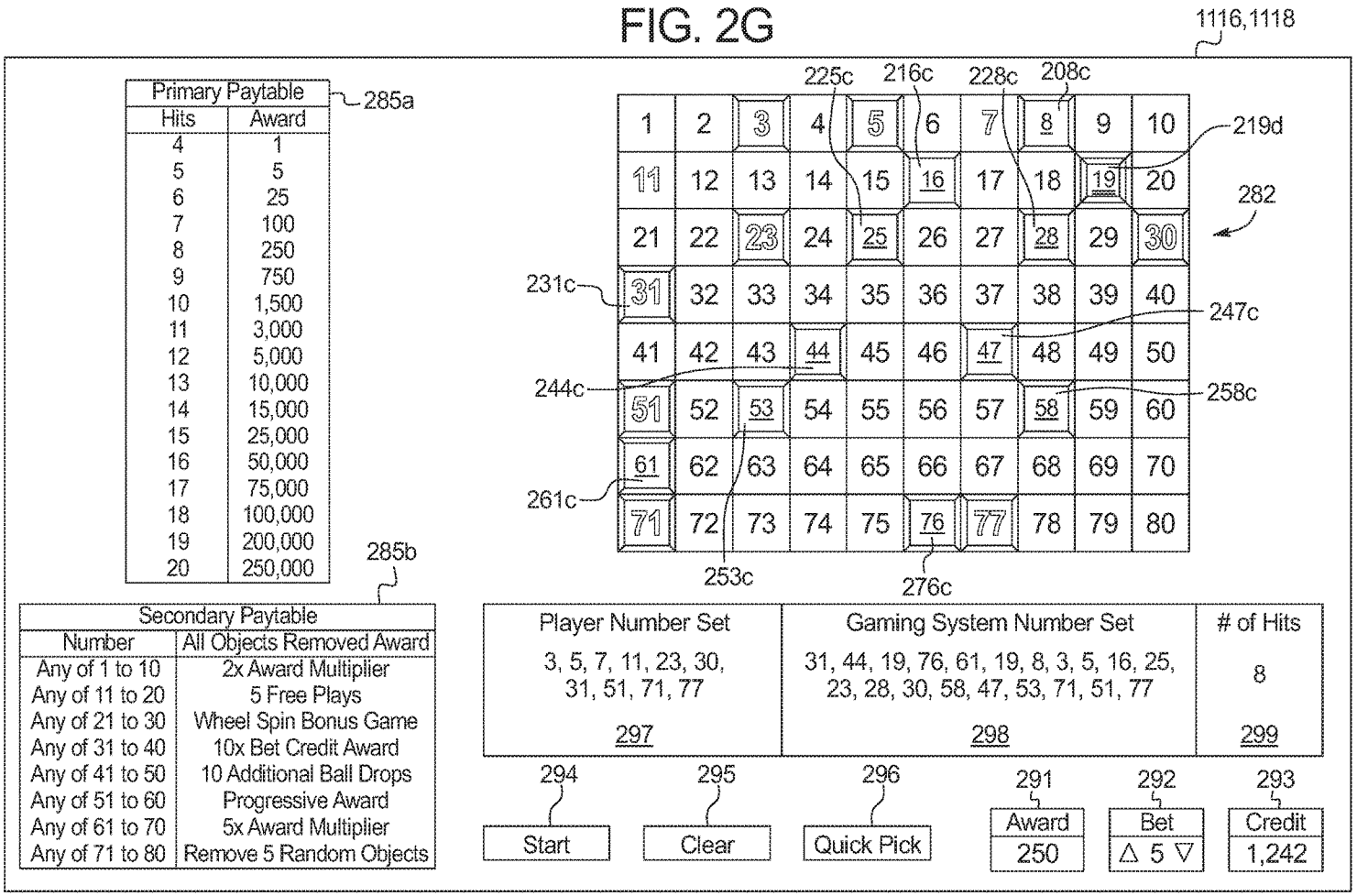

As shown in FIG. 2G, the gaming system has completed the gaming system keno number set by selecting fourteen additional keno numbers 8, 3, 5, 16, 25, 23, 28, 30, 58, 47, 53, 71, 51, and 77 to include in the gaming system keno number set. The gaming system displays the selected keno numbers of the gaming system keno number set in the gaming system keno number set meter 298. The gaming system increments the hit meter 299 to eight because the keno numbers 3, 5, 23, 30, 31, 51, 71, and 77 in the gaming system keno number set match the keno numbers 3, 5, 23, 30, 31, 51, 71, and 77 included in the player keno number set.

The gaming system determined that the object removal event occurred following the selection of each of the fourteen additional keno numbers 8, 3, 5, 16, 25, 23, 28, 30, 58, 47, 53, 71, 51, and 77 to include in the gaming system keno number set. Accordingly, the gaming system removed the first objects 208*b*, 203*b*, 205*b*, 216*b*, 225*b*, 223*b*, 228*b*, 230*b*, 258*b*, 247*b*, 253*b*, 271*b*, 251*b*, and 277*b*, which are respectively associated with the keno numbers 8, 3, 5, 16, 25, 23, 28, 30, 58, 47, 53, 71, 51, and 77 from the objet display area. Since the second objects associated with the keno numbers 8, 3, 5, 16, 25, 23, 28, 30, 58, 47, 53, 71, 51, and 77 are still displayed in the object display area following the removal of the first objects 208*b*, 203*b*, 205*b*, 216*b*, 225*b*, 223*b*, 228*b*, 230*b*, 258*b*, 247*b*, 253*b*, 271*b*, 251*b*, and 277*b*, the gaming system determines that the secondary award triggering event did not occur in association with the removal of any of those first objects from the object display area.

The gaming system makes a primary award determination for the play of the keno game by determining how many "Hits" occurred. As noted above, the hit meter 299 displays eight "Hits" for the play of the keno game. The gaming system determines a primary award of 250 credits based on the primary paytable 285*a* and displays the primary award of 250 credits in the award meter 291.

In other embodiments, the objects are not necessarily arranged such that objects associated with like keno numbers are aligned with one another.

In certain embodiments, the value of the secondary award increases as the gaming system removes objects from deeper layers. For instance, in one example embodiment, the keno game is associated with four sets of objects layered one atop the other in first (topmost) through fourth (bottommost) layers. In this example embodiment, the objects associated with the keno number 33 are each associated with a secondary award of Free Games. Here, the value of the secondary award increases moving from the first to the fourth layer such that: (1) the object in the first (topmost) layer associated with the keno number 33 is associated with a secondary award of 1 Free Game, (2) the object in the second layer associated with the keno number 33 is associated with a secondary award of 3 Free Games, (3) the object in the third layer associated with the keno number 33 is associated with a secondary award of 8 Free Games, and (4) the object in the fourth (bottommost) layer associated with the keno number 33 is associated with a secondary award of 15 Free Games.

In certain embodiments (such as the embodiment described above with respect to FIGS. 2A to 2G), the gaming system selects keno numbers from the set of keno numbers for inclusion in the gaming system keno number set with replacement, while in other embodiments the gaming system selects keno numbers from the set of keno numbers for inclusion in the gamin system keno number set without replacement.

In various embodiments, the keno game is associated with a secondary collection game. In these embodiments, a plurality of the objects are each associated with one of a plurality of different items associated with the collection game. If the gaming system removes an object associated with an item, the gaming system collects or accumulates that item for the player for use in the collection game. The gaming system determines and provides an award when the player has collected a designated quantity of items or a designated set of items.

For instance, in one example embodiment, the collection game is a poker-themed game and the items are playing cards from a fifty-two card deck of playing cards. In this example embodiment, when the gaming system removes an object associated with a playing card, the gaming system collects that playing card for the player. When the player has collected five playing cards to form a five-card player hand of playing cards, the gaming system compares the player hand of playing cards to a collection game paytable to determine whether to provide the player a collection game award.

In various embodiments, the gaming system may re-display or replace an object after the gaming system has previously removed that particular object. For instance, in one example embodiment, the gaming system randomly determines when to re-display at least one randomly-determined, previously-removed object. In another example embodiment, the gaming system re-displays at least one randomly-determined, previously-removed object according to a predetermined schedule (such as upon the initiation of or the conclusion of a play of the keno game).

In certain embodiments, the keno game is a persistence game in which the gaming system maintains the object's display status (i.e., whether that object is displayed or has been removed and is no longer displayed) from play to play, regardless of which particular player is playing at any point in time. In other embodiments, the keno game is a personal persistence game in which the gaming system maintains the object's display status (i.e., whether that object is displayed or has been removed and is no longer displayed) for a particular player from play to play and gaming session to gaming session.

Figure 3A:
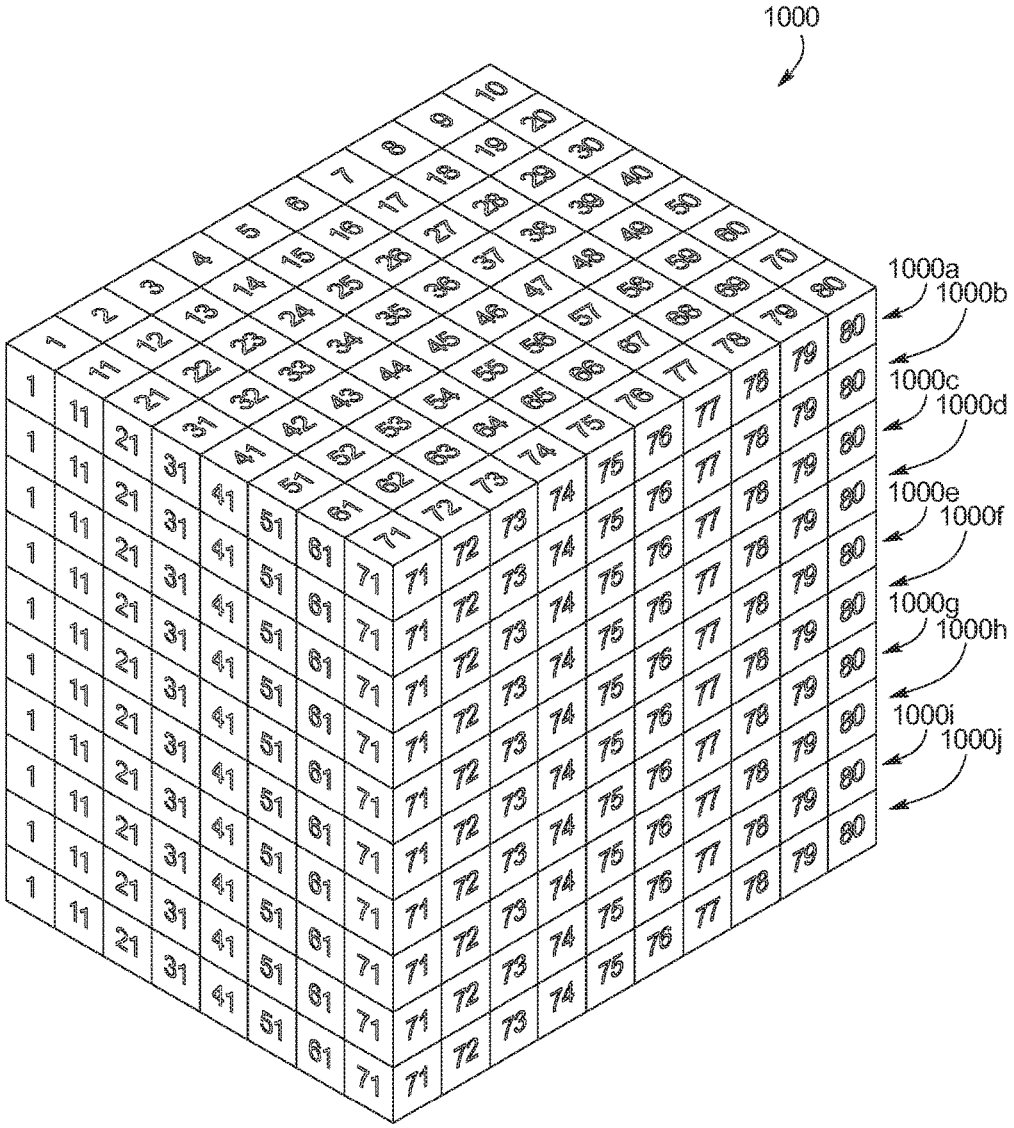
FIG. 3A illustrates one example embodiment of a structure including ten layers of objects.
Figure 3B:
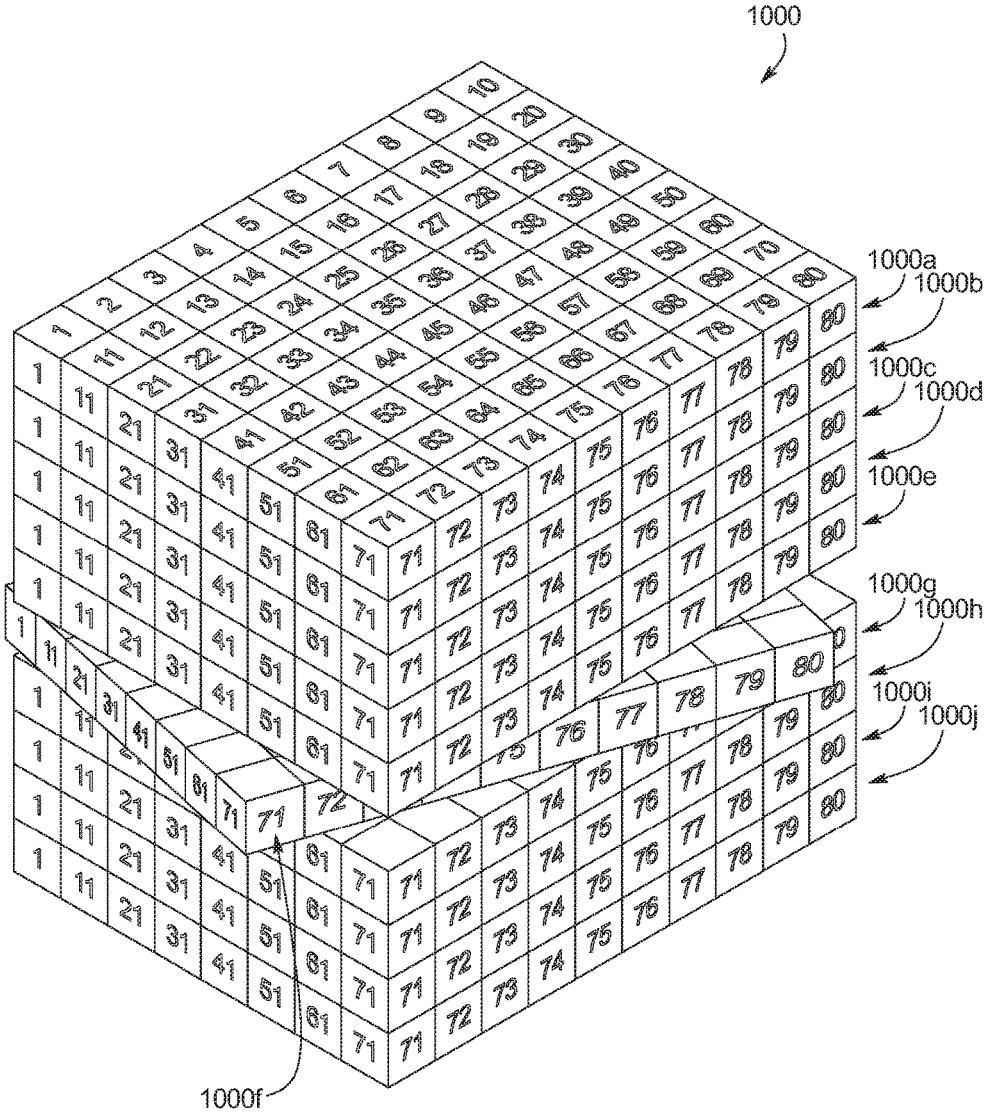
FIG. 3B illustrates the structure of FIG. 3A while one of the layers is being rotated.
Figure 3C:
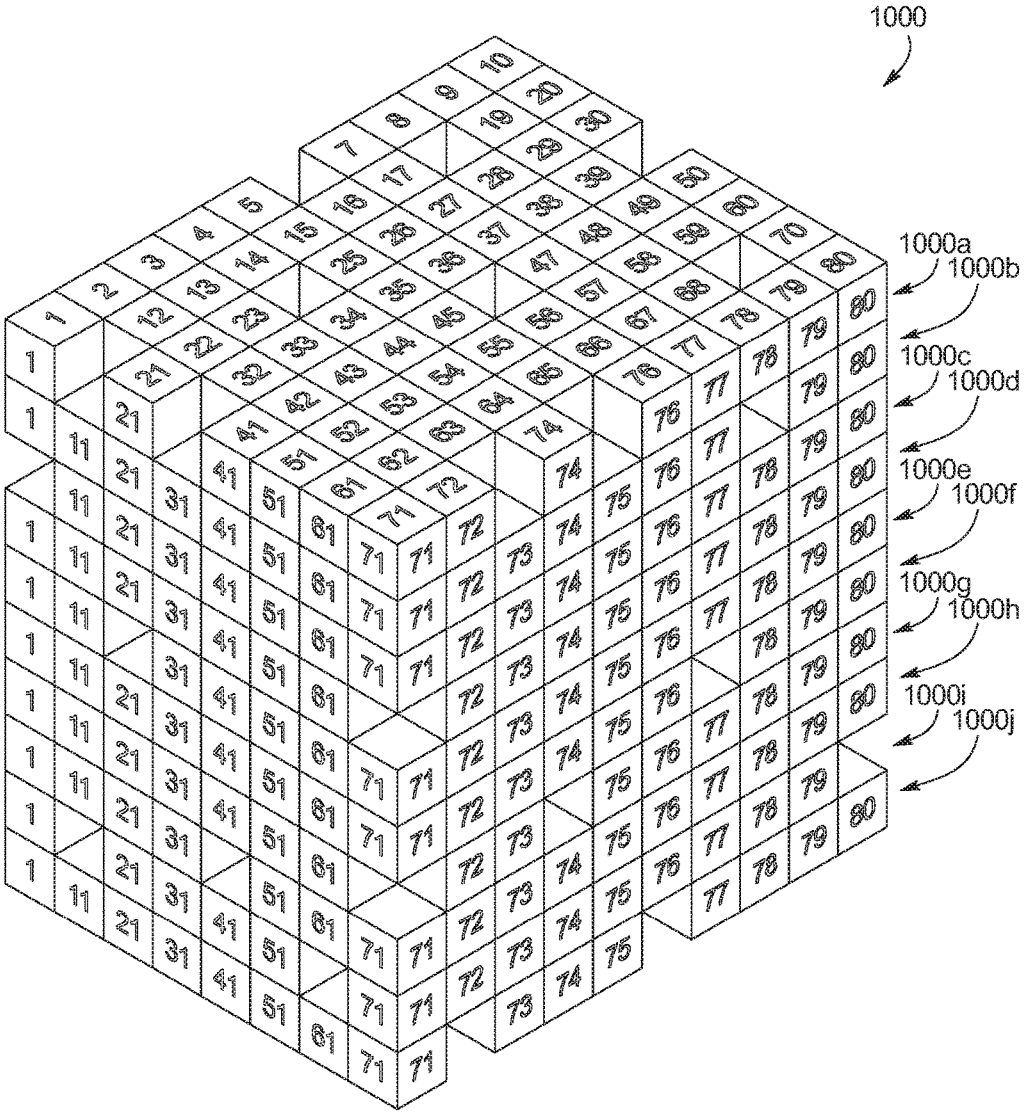
FIG. 3C illustrates the structure of FIG. 3A after a plurality of objects has been removed.

In certain embodiments, the gaming system enables the entire structure of layers and/or certain portions of the structure of layers to be rotated. FIG. 3A illustrates one example embodiment of a structure 1000 including ten layers 1000*a*, 1000*b*, 1000*c*, 1000*d*, 1000*e*, 1000*f*, 1000*g*, 1000*h*, 1000*i*, and 1000*j*. As shown in FIG. 3B, in this example embodiment, the gaming system rotates the layer 1000*e* about a substantially vertical axis through its center, such as upon an occurrence of a triggering event. In another embodiment (not shown), the gaming system rearranges (such as by rotating) a portion of the structure including objects from a plurality of layers, such as a 3×3×3 portion of the structure. In another example embodiment, the gaming system uses each "side" of the structure as a keno board for an individual keno game or an individual ball drop for a play of a keno game including multiple ball drops. This enables objects to be removed from all sides of the structure, as shown in FIG. 3C.

It should be appreciated that:

(a) the object removal event;

(b) the secondary award triggering event;

(c) the quantity of objects;

(d) the quantity of layers;

(e) the arrangement of objects within layers;

(f) the keno numbers associated with the objects;

(g) the secondary awards; and/or (h) any other variables and determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM; (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as an electronic gaming machine located on a casino floor). Additionally, for brevity and clarity and unless specifically stated otherwise, "EGM" as used herein represents one EGM or a plurality of EGMs, "personal computing device" as used herein represents one personal computing device or a plurality of personal computing devices, and "central server, central controller, or remote host" as used herein represents one central server, central controller, or remote host or a plurality of central servers, central controllers, or remote hosts.

Figure 4:
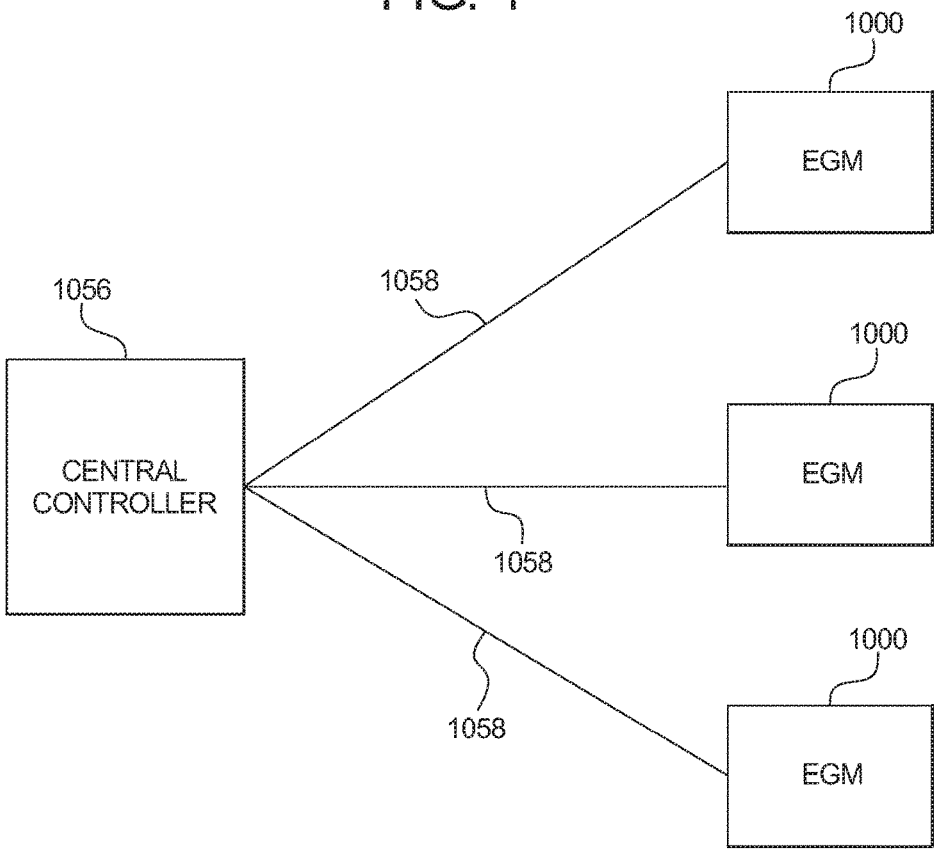
FIG. 4 is a schematic block diagram of an example network configuration of one embodiment of the gaming system of the present disclosure.

As noted above, in various embodiments, the gaming system includes an EGM (or personal computing device) in combination with a central server, central controller, or remote host. In such embodiments, the EGM (or personal computing device) is configured to communicate with the central server, central controller, or remote host through a data network or remote communication link. In certain such embodiments, the EGM (or personal computing device) is configured to communicate with another EGM (or personal computing device) through the same data network or remote communication link or through a different data network or remote communication link. For example, the gaming system illustrated in FIG. 4 includes a plurality of EGMs 1000 that are each configured to communicate with a central server, central controller, or remote host 1056 through a data network 1058.

In certain embodiments in which the gaming system includes an EGM (or personal computing device) in combination with a central server, central controller, or remote host, the central server, central controller, or remote host is any suitable computing device (such as a server) that includes at least one processor and at least one memory device or data storage device. As further described herein, the EGM (or personal computing device) includes at least one EGM (or personal computing device) processor configured to transmit and receive data or signals representing events, messages, commands, or any other suitable information between the EGM (or personal computing device) and the central server, central controller, or remote host. The at least one processor of that EGM (or personal computing device) is configured to execute the events, messages, or commands represented by such data or signals in conjunction with the operation of the EGM (or personal computing device). Moreover, the at least one processor of the central server, central controller, or remote host is configured to transmit and receive data or signals representing events, messages, commands, or any other suitable information between the central server, central controller, or remote host and the EGM (or personal computing device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal computing device). Further, one, more than one, or each of the functions of the at least one processor of the EGM (or personal computing device) may be performed by the at least one processor of the central server, central controller, or remote host.

In certain such embodiments, computerized instructions for controlling any games (such as any primary or base games and/or any secondary or bonus games) displayed by the EGM (or personal computing device) are executed by the central server, central controller, or remote host. In such "thin client" embodiments, the central server, central controller, or remote host remotely controls any games (or other suitable interfaces) displayed by the EGM (or personal computing device), and the EGM (or personal computing device) is utilized to display such games (or suitable interfaces) and to receive one or more inputs or commands. In other such embodiments, computerized instructions for controlling any games displayed by the EGM (or personal computing device) are communicated from the central server, central controller, or remote host to the EGM (or personal computing device) and are stored in at least one memory device of the EGM (or personal computing device). In such "thick client" embodiments, the at least one processor of the EGM (or personal computing device) executes the computerized instructions to control any games (or other suitable interfaces) displayed by the EGM (or personal computing device).

In various embodiments in which the gaming system includes a plurality of EGMs (or personal computing devices), one or more of the EGMs (or personal computing devices) are thin client EGMs (or personal computing devices) and one or more of the EGMs (or personal computing devices) are thick client EGMs (or personal computing devices). In other embodiments in which the gaming system includes one or more EGMs (or personal computing devices), certain functions of one or more of the EGMs (or personal computing devices) are implemented in a thin client environment, and certain other functions of one or more of the EGMs (or personal computing devices) are implemented in a thick client environment. In one such embodiment in which the gaming system includes an EGM (or personal computing device) and a central server, central controller, or remote host, computerized instructions for controlling any primary or base games displayed by the EGM (or personal computing device) are communicated from the central server, central controller, or remote host to the EGM (or personal computing device) in a thick client configuration, and computerized instructions for controlling any secondary or bonus games or other functions displayed by the EGM (or personal computing device) are executed by the central server, central controller, or remote host in a thin client configuration.

In certain embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a local area network (LAN) in which the EGMs (or personal computing devices) are located substantially proximate to one another and/or the central server, central controller, or remote host. In one example, the EGMs (or personal computing devices) and the central server, central controller, or remote host are located in a gaming establishment or a portion of a gaming establishment.

In other embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is a wide area network (WAN) in which one or more of the EGMs (or personal computing devices) are not necessarily located substantially proximate to another one of the EGMs (or personal computing devices) and/or the central server, central controller, or remote host. For example, one or more of the EGMs (or personal computing devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal computing devices) are located. In certain embodiments in which the data network is a WAN, the gaming system includes a central server, central controller, or remote host and an EGM (or personal computing device) each located in a different gaming establishment in a same geographic area, such as a same city or a same state. Gaming systems in which the data network is a WAN are substantially identical to gaming systems in which the data network is a LAN, though the quantity of EGMs (or personal computing devices) in such gaming systems may vary relative to one another.

In further embodiments in which the gaming system includes: (a) an EGM (or personal computing device) configured to communicate with a central server, central controller, or remote host through a data network; and/or (b) a plurality of EGMs (or personal computing devices) configured to communicate with one another through a data network, the data network is an internet (such as the Internet) or an intranet. In certain such embodiments, an Internet browser of the EGM (or personal computing device) is usable to access an Internet game page from any location where an Internet connection is available. In one such embodiment, after the EGM (or personal computing device) accesses the Internet game page, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal computing device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal computing device). Examples of implementations of Internet-based gaming are further described in U.S. Pat. No. 8,764,566, entitled "Internet Remote Game Server," and U.S. Pat. No. 8,147,334, entitled "Universal Game Server," which are incorporated herein by reference.

The central server, central controller, or remote host and the EGM (or personal computing device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal computing devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5:
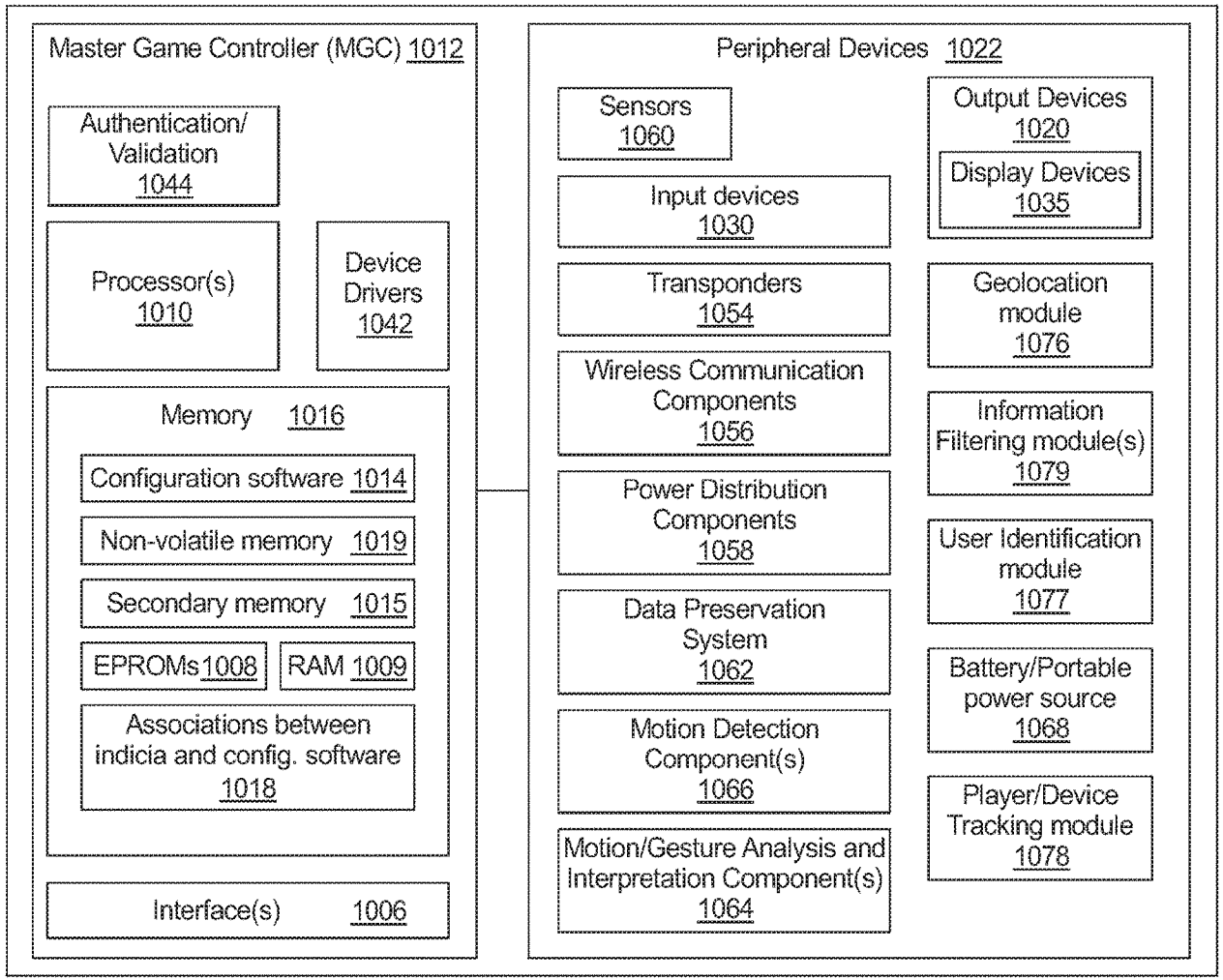
FIG. 5 is a schematic block diagram of an example electronic configuration of one embodiment of the electronic gaming machine (EGM) of the present disclosure.
Figure 6A:
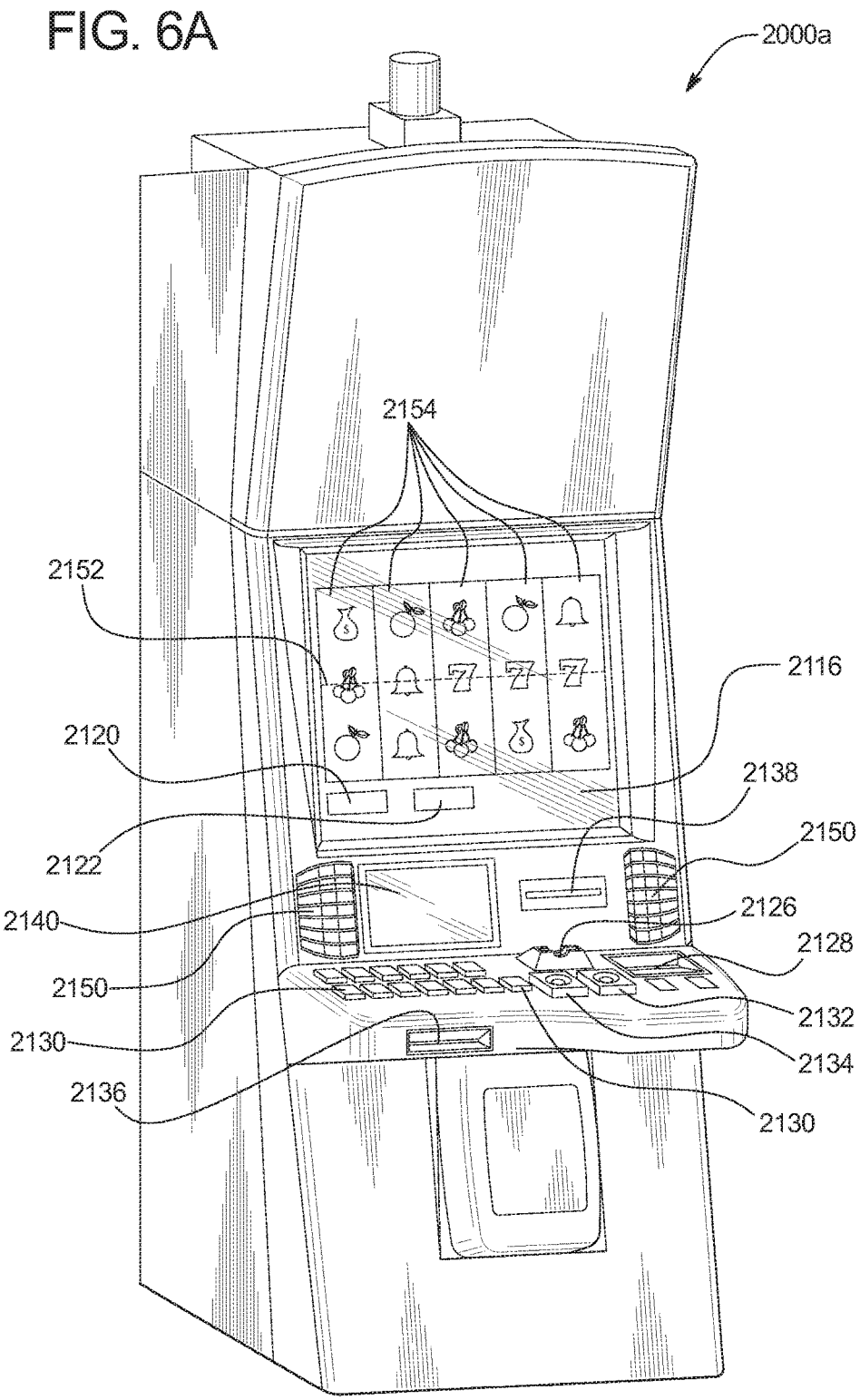
FIGS. 6A and 6B are perspective views of example alternative embodiments of EGMs of the present disclosure.
Figure 6B:
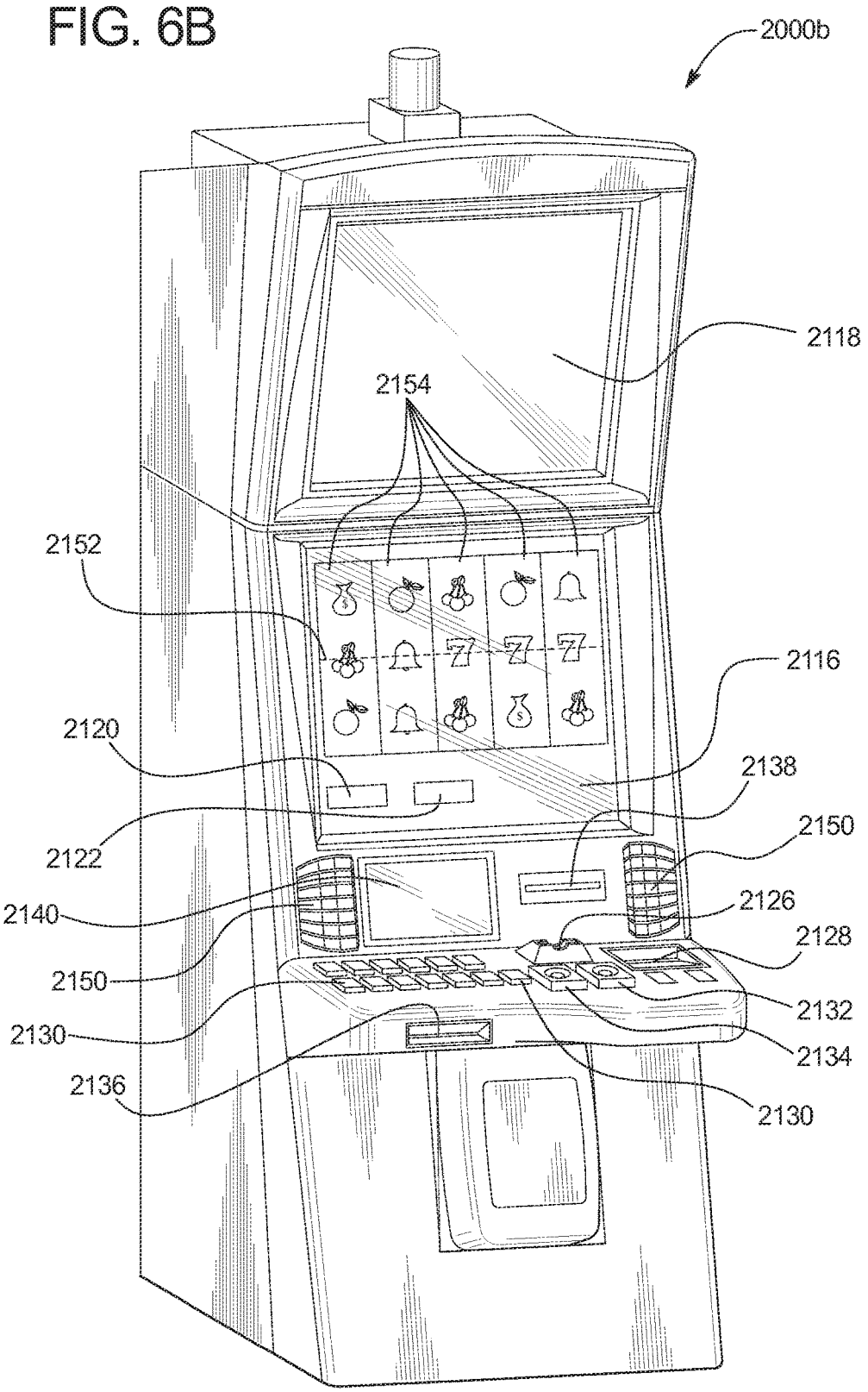

FIG. 5 is a block diagram of an example EGM 1000 and FIGS. 6A and 6B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets," which is incorporated herein by reference.

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 6A includes a central display device 2116, a player tracking display 2140, a credit display 2120, and a bet display 2122. The example EGM 2000*b* illustrated in FIG. 6B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 6A and 6B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons," which are incorporated herein by reference.

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine," which is incorporated herein by reference.

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 6A and 6B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrates in FIGS. 6A and 6B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine," which is incorporated herein by reference. When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 6A and 6B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and

2000*b* illustrated in FIGS. 6A and 6B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 6A and 6B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 6A and 6B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 6A and 6B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 6A and 6B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game," which are incorporated herein by reference.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern," which are incorporated herein by reference.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services," which are incorporated herein by reference.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electromechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 6B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one processor;

at least one display device supported by the housing;

a plurality of input devices supported by the housing, the plurality of input devices including an acceptor; and at least one memory device that stores a plurality of instructions that, when executed by the at least one processor, cause the at least one processor to:

responsive to receipt, by the acceptor, of a physical item associated with a monetary value, establish a credit balance based at least in part on the monetary value associated with the physical item;

cause the at least one display device to display an object display area including a displayed first set of multiple objects and a second set of multiple objects, wherein, for each of the first and second sets of objects, each object of that set is associated with a different keno number of a set of different keno numbers, wherein a first object of the first set and a first object of the second set are both associated with a first one of the keno numbers;

form a player keno number set including one or more keno numbers of the set of different keno numbers;

place a wager responsive to receipt, by a first one of the input devices, of a wager input, the credit balance being decreasable by the wager;

select one of the keno numbers from the set of different keno numbers;

add the selected keno number to a gaming system keno number set;

responsive to an occurrence of an object removal event:

cause the at least one display device to display a removal of one of the displayed objects such that said object is no longer displayed in the object display area;

responsive to an occurrence of a secondary award triggering event that is based on the removal of at least two of said objects associated with a same one of the keno numbers and that is different from the object removal event, determine a secondary award; and cause the at least one display device to display the determined secondary award;

finalize the gaming system keno number set such that the gaming system keno number set includes a designated quantity of keno numbers;

determine any primary award based on the wager and a comparison of the one or more keno numbers of the player keno number set with the selected keno numbers of the gaming system keno number set, the credit balance being increasable by any primary award;

cause the at least one display device to display any primary award; and responsive to receipt, by a second one of the input devices, of a cashout input, initiate a payout associated with the credit balance.

2. The gaming system of claim 1, wherein the object removal event occurs when said keno number is selected and at least one object associated with said selected keno number is displayed in the object display area.

3. The gaming system of claim 2, wherein the plurality of instructions, when executed by the at least one processor, cause the at least one processor to, responsive to the occurrence of the object removal event, cause the at least one display device to display a removal of a displayed object associated with said selected keno number such that said selected keno number is no longer displayed in the object display area.

4. The gaming system of claim 3, wherein the secondary award triggering event occurs when no more objects associated with said selected keno number are displayed as a result of the removal of said object.

5. The gaming system of claim 3, wherein the secondary award triggering event occurs when a designated quantity of objects associated with said selected keno number have been removed, the designated quantity being at least two.

6. The gaming system of claim 3, wherein the second set of objects is initially hidden behind the displayed first set of objects, and wherein the plurality of instructions, when executed by the at least one processor, cause the at least one processor to, responsive to the occurrence of the object removal event, cause the at least one display device to display a removal of the displayed object associated with said selected keno number such that said object is no longer displayed in the object display area and such that one of the objects of the second set of objects also associated with said selected keno number is revealed.

7. The gaming system of claim 2, wherein the plurality of instructions, when executed by the at least one processor, cause the at least one processor to, responsive to the occurrence of the object removal event, cause the at least one display device to display a removal of a plurality of displayed objects such that said plurality of objects are no longer displayed in the object display area.

8. The gaming system of claim 1, wherein the first one of the input devices includes one of a first physical button and a touch screen and wherein the second one of the input devices includes one of a second physical button and the touch screen.

9. The gaming system of claim 1, wherein the second set of objects is initially hidden behind the displayed first set of objects, and wherein the plurality of instructions, when executed by the at least one processor, cause the at least one processor to, responsive to the occurrence of the object removal event, cause the at least one display device to display a removal of one of the displayed objects of the first set of objects such that said object is no longer displayed in the object display area and such that one of the objects of the second set of objects is revealed.

10. The gaming system of claim 1, wherein the plurality of instructions, when executed by the at least one processor, cause the at least one processor to finalize the gaming system keno number set at least in part by selecting another one of the keno numbers from the set of different keno numbers, adding the selected keno number to a gaming system keno number set, and responsive to a second occurrence of the object removal event:

cause the at least one display device to display a removal of a second one of the displayed objects such that said second object is no longer displayed in the object display area; and responsive to a second occurrence of the secondary award triggering event based on the removal of said second object, determine a second secondary award and cause the at least one display device to display the second secondary award.

11. A method of operating a gaming system, said method comprising:

responsive to receipt, by an acceptor, of a physical item associated with a monetary value, establishing, by at least one processor, a credit balance based at least in part on the monetary value associated with the physical item;

causing, by the at least one processor, at least one display device to display an object display area including a displayed first set of multiple objects and a second set of multiple objects, wherein, for each of the first and second sets of objects, each object of that set is associated with a different keno number of a set of different keno numbers, wherein a first object of the first set and a first object of the second set are both associated with a first one of the keno numbers;

forming, by the at least one processor, a player keno number set including one or more keno numbers of the set of different keno numbers;

placing, by the at least one processor, a wager responsive to receipt, by a first input device, of a wager input, the credit balance being decreasable by the wager;

selecting, by the at least one processor, one of the keno numbers from the set of different keno numbers;

adding, by the at least one processor, the selected keno number to a gaming system keno number set;

responsive to an occurrence of an object removal event:

causing, by the at least one processor, the at least one display device to display a removal of one of the displayed objects such that said object is no longer displayed in the object display area;

responsive to an occurrence of a secondary award triggering event based on the removal of at least two of said objects associated with a same one of the keno numbers and that is different from the object removal event, determining, by the at least one processor, a secondary award; and causing, by the at least one processor, the at least one display device to display the determined secondary award;

finalizing, by the at least one processor, the gaming system keno number set such that the gaming system keno number set includes a designated quantity of keno numbers;

determining, by the at least one processor, any primary award based on the wager and a comparison of the one or more keno numbers of the player keno number set with the selected keno numbers of the gaming system keno number set, the credit balance being increasable by any primary award;

causing, by the at least one processor, the at least one display device to display any primary award; and responsive to receipt, by a second input device, of a cashout input, initiating, by the at least one processor, a payout associated with the credit balance.

12. The method of claim 11, wherein the object removal event occurs when said keno number is selected and at least one object associated with said selected keno number is displayed in the object display area.

13. The method of claim 12, which includes causing, by the at least one processor, the at least one display device to, responsive to the occurrence of the object removal event, display a removal of a displayed object associated with said selected keno number such that said selected keno number is no longer displayed in the object display area.

14. The method of claim 13, wherein the secondary award triggering event occurs when no more objects associated with said selected keno number are displayed as a result of the removal of said object.

15. The method of claim 13, wherein the secondary award triggering event occurs when a designated quantity of objects associated with said selected keno number have been removed, the designated quantity being at least two.

16. The method of claim 13, wherein the second set of objects is initially hidden behind the displayed first set of objects, and which includes causing, by the at least one processor, the at least one display device to, responsive to the occurrence of the object removal event, display a removal of the displayed object associated with said selected keno number such that said object is no longer displayed in the object display area and such that one of the objects of the second set of objects also associated with said selected keno number is revealed.

17. The method of claim 12, which includes causing, by the at least one processor, the at least one display device to, responsive to the occurrence of the object removal event, display a removal of a plurality of displayed objects such that said plurality of objects are no longer displayed in the object display area.

18. The method of claim 11, which is at least partially provided through a data network.

19. The method of claim 18, wherein the data network is an internet.

20. The method of claim 11, wherein the first input device includes one of a first physical button and a touch screen and wherein the second input device includes one of a second physical button and the touch screen.

21. The method of claim 11, wherein the second set of objects is initially hidden behind the displayed first set of objects, and which includes causing, by the at least one processor, the at least one display device to, responsive to the occurrence of the object removal event, display a removal of one of the displayed objects of the first set of objects such that said object is no longer displayed in the object display area and such that one of the objects of the second set of objects is revealed.

22. The method of claim 11, wherein finalizing the gaming system keno number set includes selecting, by the at least one processor, another one of the keno numbers from the set of different keno numbers; adding, by the at least one processor, the selected keno number to a gaming system keno number set; and responsive to a second occurrence of the object removal event:

causing, by the at least one processor, the at least one display device to display a removal of a second one of the displayed objects such that said second object is no longer displayed in the object display area; and responsive to a second occurrence of the secondary award triggering event based on the removal of said second object, determining, by the at least one processor, a second secondary award and causing, by the at least one processor, the at least one display device to display the second secondary award.

* * * * *